US009427971B2

(12) United States Patent
Kobayashi

(10) Patent No.: US 9,427,971 B2
(45) Date of Patent: Aug. 30, 2016

(54) PRINTER WITH A CLEANABLE NOZZLE SURFACE

(71) Applicant: BROTHER KOGYO KABUSHIKI KAISHA, Nagoya-shi, Aichi-ken (JP)

(72) Inventor: Haruo Kobayashi, Ichinomiya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 2 days.

(21) Appl. No.: 14/809,696

(22) Filed: Jul. 27, 2015

(65) Prior Publication Data

US 2016/0031222 A1 Feb. 4, 2016

(30) Foreign Application Priority Data

Jul. 29, 2014 (JP) ..... 2014-153543

(51) Int. Cl.
*B41J 2/165* (2006.01)

(52) U.S. Cl.
CPC ..... *B41J 2/16552* (2013.01); *B41J 2/1652* (2013.01); *B41J 2/16508* (2013.01); *B41J 2/16523* (2013.01); *B41J 2/16538* (2013.01)

(58) Field of Classification Search
CPC .... B41J 2/165; B41J 2/1652; B41J 2/16523; B41J 2/16532; B41J 2/16508; B41J 2/16547; B41J 2/16552; B41J 2/16555
USPC ..... 347/5, 9, 14, 29–33, 36
See application file for complete search history.

(56) References Cited

U.S. PATENT DOCUMENTS 5,559,536 A * 9/1996 Saito ..... B41J 2/16508 347/25
2013/0010028 A1* 1/2013 Taira ..... B41J 2/165 347/25
2014/0240395 A1* 8/2014 Shindo ..... B41J 2/16523 347/29

FOREIGN PATENT DOCUMENTS

JP 07290723 A * 11/1995
JP 2000-062213 A 2/2000
JP 2010120266 A * 6/2010

* cited by examiner

*Primary Examiner* — Jason Uhlenhake
(74) *Attorney, Agent, or Firm* — Fox Rothschild LLP

(57) ABSTRACT

A printer includes a head, a wiper, a cap, a supply flow path, a supply opening/closing valve, a gas channel, a gas opening/closing valve, a waste fluid flow path, a suction portion, and a processor. The processor is configured to set a covered state in which the cap covers the at least one nozzle, supply the cleaning fluid to the cap, in the covered state, by opening the supply opening/closing valve, closing the gas opening/closing valve, and driving the suction portion, discharge the cleaning fluid, in the covered state, by closing the supply opening/closing valve, opening the gas opening/closing valve, and driving the suction portion, set an uncovered state in which covering the at least one nozzle by the cap is released, and cause the wiper to slide in contact with the nozzle surface, in the uncovered state, by moving the wiper relatively with respect to the nozzle surface.

15 Claims, 17 Drawing Sheets

PRINTER WITH A CLEANABLE NOZZLE SURFACE

CROSS-REFERENCE TO RELATED APPLICATION

This application claims priority to Japanese Patent Application No. 2014-153543 filed Jul. 29, 2014, the content of which is hereby incorporated herein by reference.

BACKGROUND

The present disclosure relates to a printer that can clean a nozzle surface including a nozzle.

A printer is known that can clean a nozzle surface including a nozzle. For example, a known inject recording device is configured to execute a maintenance operation that cleans a nozzle surface. When the inkjet recording device executes the maintenance operation, the inkjet recording device causes a cap to closely fit to a nozzle surface of a print head. In this state, the inkjet recording device operates a suction portion and sucks out ink from the print head. Next, the inkjet recording device causes a cleaning fluid to flow into the cap, and stands by for a specified time period. After that, the inkjet recording device removes the cap from the nozzle surface and wipes the nozzle surface using a wiping portion.

SUMMARY

When the cap is removed from the nozzle surface in a state in which the cleaning fluid is in the cap, the cleaning fluid attached to the nozzle surface is separated from the cleaning fluid stored in the cap. At this time, due to the surface tension of the cleaning fluid, the cleaning fluid may remain on the leading end portion of the cap on the nozzle surface. The cleaning fluid may be mixed with ink. Therefore, when the cleaning fluid on the leading end portion of the cap dries out, the ink may be attached firmly to the leading end portion of the cap. When ink is attached firmly to the leading end portion of the cap, it becomes difficult for the cap to closely fit to the nozzle surface. In this case, for example, the firmly attached ink may cause a gap between the cap and the nozzle surface and the cleaning fluid may leak. In such a case, there is a possibility that it becomes more difficult to clean the nozzle surface. As a result, it is possible that the ink is not cleaned from the nozzle surface, the ink remains on the nozzle surface and becomes firmly attached thereto, and nozzle clogging occurs. It is thus possible that print quality may deteriorate.

Embodiments of the broad principles derived herein provide a printer that is capable of reducing a possibility of nozzle clogging and resultant deterioration in print quality.

Embodiments provide a printer that includes a head, a wiper, a cap, a supply flow path, a supply opening/closing valve, a gas channel, a gas opening/closing valve, a waste fluid flow path, a suction portion, and a processor. The head includes a nozzle surface. The nozzle surface is a surface including at least one nozzle configured to eject an ejection fluid. The wiper is configured to move relatively with respect to the nozzle surface. The wiper is configured to slide in contact with the nozzle surface. The cap is configured to be opposed to the nozzle surface. The cap is configured to fit closely to the nozzle surface and to cover the at least one nozzle. The supply flow path is connected to the cap. The supply flow path is a flow path configured to supply a cleaning fluid to the cap. The supply opening/closing valve is provided on the supply flow path. The supply opening/closing valve is configured to open and close the supply flow path. The gas channel is connected to the cap. The gas opening/closing valve is configured to open and close the gas channel. The waste fluid flow path is connected to the cap. The waste fluid flow path is a flow path configured to discharge the cleaning fluid supplied to the cap. The suction portion is connected to the waste fluid flow path. The suction portion is configured to perform suction. The processor is configured to set a covered state in which the cap covers the at least one nozzle, supply the cleaning fluid to the cap via the supply flow path, in the covered state, by opening the supply opening/closing valve, closing the gas opening/closing valve, and driving the suction portion, discharge, via the waste fluid flow path, the cleaning fluid supplied to the cap, in the covered state, by closing the supply opening/closing valve, opening the gas opening/closing valve, and driving the suction portion, set an uncovered state in which covering the at least one nozzle by the cap is released, and cause the wiper to slide in contact with the nozzle surface, in the uncovered state, by moving the wiper relatively with respect to the nozzle surface.

Embodiments also provide a printer that includes a head, a wiper, a cap, a plurality of supply flow paths, a plurality of supply opening/closing valves, at least one gas channel, at least one gas opening/closing valve, a waste fluid flow path, a suction portion, and a processor. The head includes a nozzle surface. The nozzle surface is a surface including at least one nozzle configured to eject an ejection fluid. The wiper is configured to move relatively with respect to the nozzle surface. The wiper is configured to slide in contact with the nozzle surface. The cap is configured to be opposed to the nozzle surface. The cap is configured to fit closely to the nozzle surface and to cover the at least one nozzle. The cap includes a plurality of areas partitioned by a partition wall. The partition wall is provided on a side, of the cap, that is configured to be opposed to the nozzle surface. The plurality of supply flow paths are respectively connected to the plurality of areas. The plurality of supply flow paths are flow paths configured to supply a cleaning fluid to the cap. The plurality of supply opening/closing valves are respectively provided on the plurality of supply flow paths. The plurality of supply opening/closing valves are respectively configured to open and close the plurality of supply flow paths. The at least one gas channel is connected to the plurality of supply flow paths. A number of the at least one gas channel is smaller than a number of the plurality of supply flow paths. The at least one gas opening/closing valve is configured to open and close the at least one gas channel. The waste fluid flow path is connected to the cap. The waste fluid flow path is a flow path configured to discharge the cleaning fluid supplied to the cap. The suction portion is connected to the waste fluid flow path. The suction portion is configured to perform suction. The processor is configured to set a covered state in which the cap covers the at least one nozzle, supply the cleaning fluid to the cap via at least one of the plurality of supply flow paths, in the covered state, by opening at least one of the plurality of supply opening/closing valves, closing the at least one gas opening/closing valve, and driving the suction portion, discharge, via the waste fluid flow path, the cleaning fluid supplied to the cap, in the covered state, by opening at least one of the plurality of supply opening/closing valves, opening the at least one gas opening/closing valve, and driving the suction portion, set an uncovered state in which covering the at least one nozzle by the cap is released, and cause the wiper to slide in contact with the nozzle surface, in the uncovered state, by moving the wiper relatively with respect to the nozzle surface.

BRIEF DESCRIPTION OF THE DRAWINGS

Embodiments will be described below in detail with reference to the accompanying drawings in which.

DETAILED DESCRIPTION

An embodiment will be explained with reference to the drawings. A configuration of a printer 1 will be explained with reference to FIG. 1 to FIG. 7. The upper side, the down side, the lower left side, the upper right side, the lower right side, and the upper left side in FIG. 1 respectively correspond to an upper side, a down side, a front side, a rear side, a right side, and a left side of the printer 1.

Figure 1:
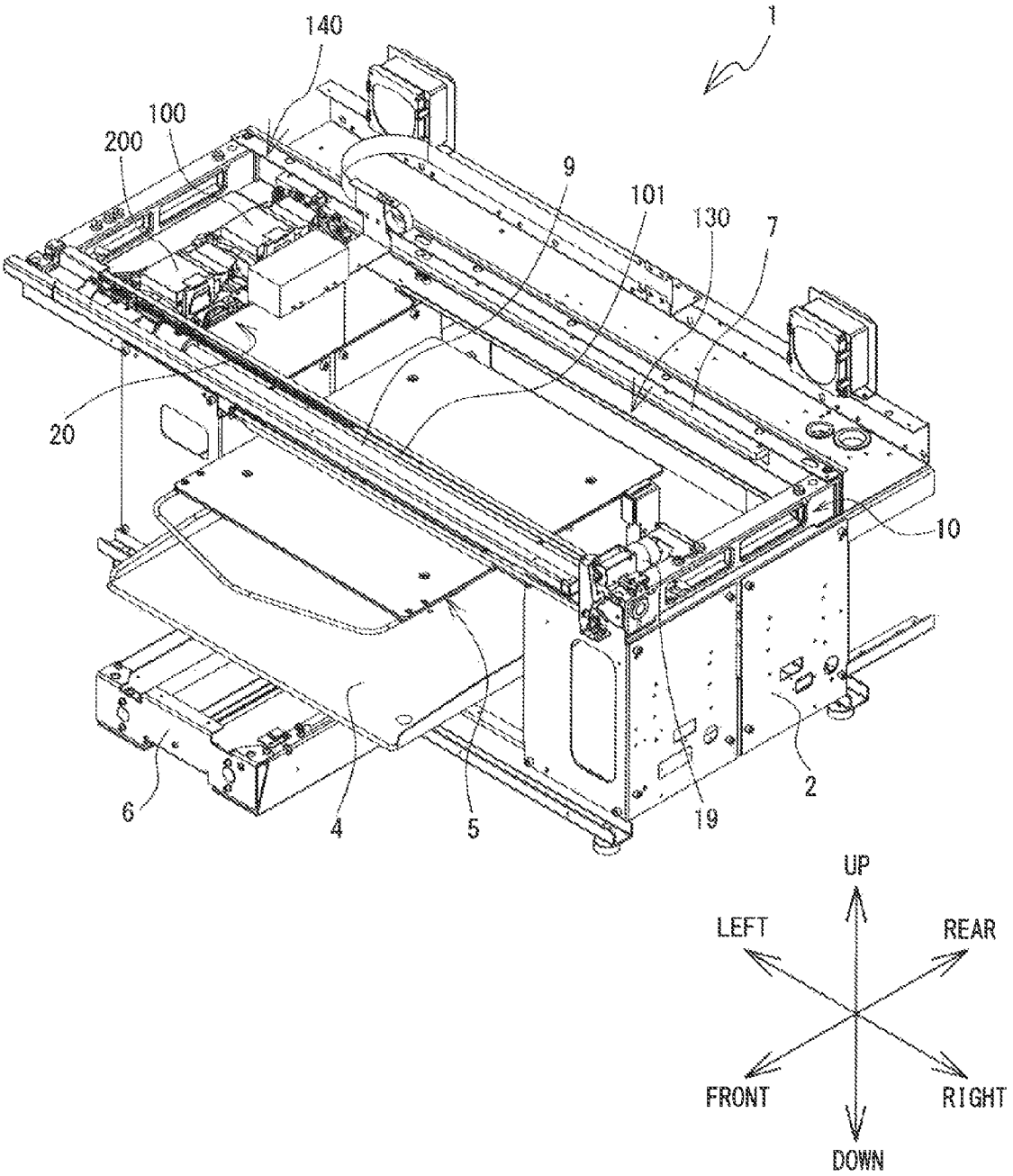
FIG. 1 is a perspective view of a printer.
Figure 10:
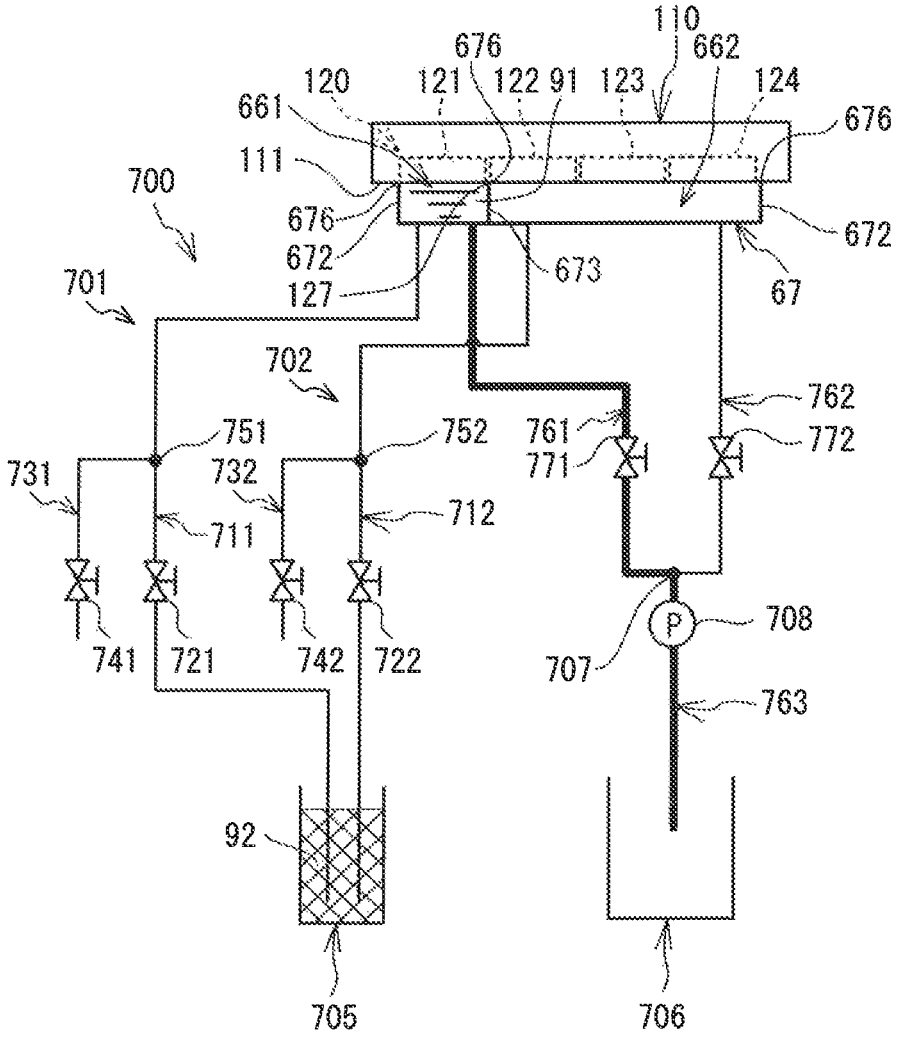
FIG. 10 is a schematic diagram of the maintenance flow path system showing a state in which ink has been drawn out from nozzles into a first area.

As shown in FIG. 1, the printer 1 is an inkjet printer that is configured to perform printing on a fabric (not shown in the drawings) such as a T-shirt, which is a print medium, by ejecting a liquid ink 91 (refer to FIG. 10). Paper or the like may be used as the print medium. In the present embodiment, the printer 1 can perform printing of a color image onto the print medium, by downwardly ejecting five different types (white (W), black (K), yellow (Y), cyan (C), and magenta (M)) of the ink 91. In the following explanation, of the five types of the ink 91, the white ink 91 is referred to as white ink. When the black, cyan, yellow, and magenta inks 91 are collectively referred to, they are referred to as color inks.

The printer 1 includes a housing 2, a platen drive mechanism 6, a pair of guide rails (not shown in the drawings), a platen 5, a tray 4, a frame body 10, a guide shaft 9, a rail 7, a carriage 20, head units 100 and 200, a drive belt 101, and a drive motor 19.

The housing 2 is a substantially cuboid shape whose long sides extend in the left-right direction. An operation portion (not shown in the drawings) is provided in a position on the front right side of the housing 2. The operation portion is used to cause the printer 1 to operate. The operation portion includes a display 49 (refer to FIG. 6) and operation buttons 501 (refer to FIG. 6). The display 49 is configured to display various information. The operation buttons 501 may be operated when an operator inputs commands relating to various operations of the printer 1.

The frame body 10 has a substantially rectangular frame shape in a plan view. The frame body 10 is provided on an upper portion of the housing 2. The front side of the frame body 10 supports the guide shaft 9. The rear side of the frame body 10 supports the rail 7. The guide shaft 9 is a shaft member that includes a shaft-shaped portion that extends in the left-right direction on the inside of the frame body 10. The rail 7 is disposed facing the guide shaft 9 and is a rod-shaped member that extends in the left-right direction.

Figure 2:
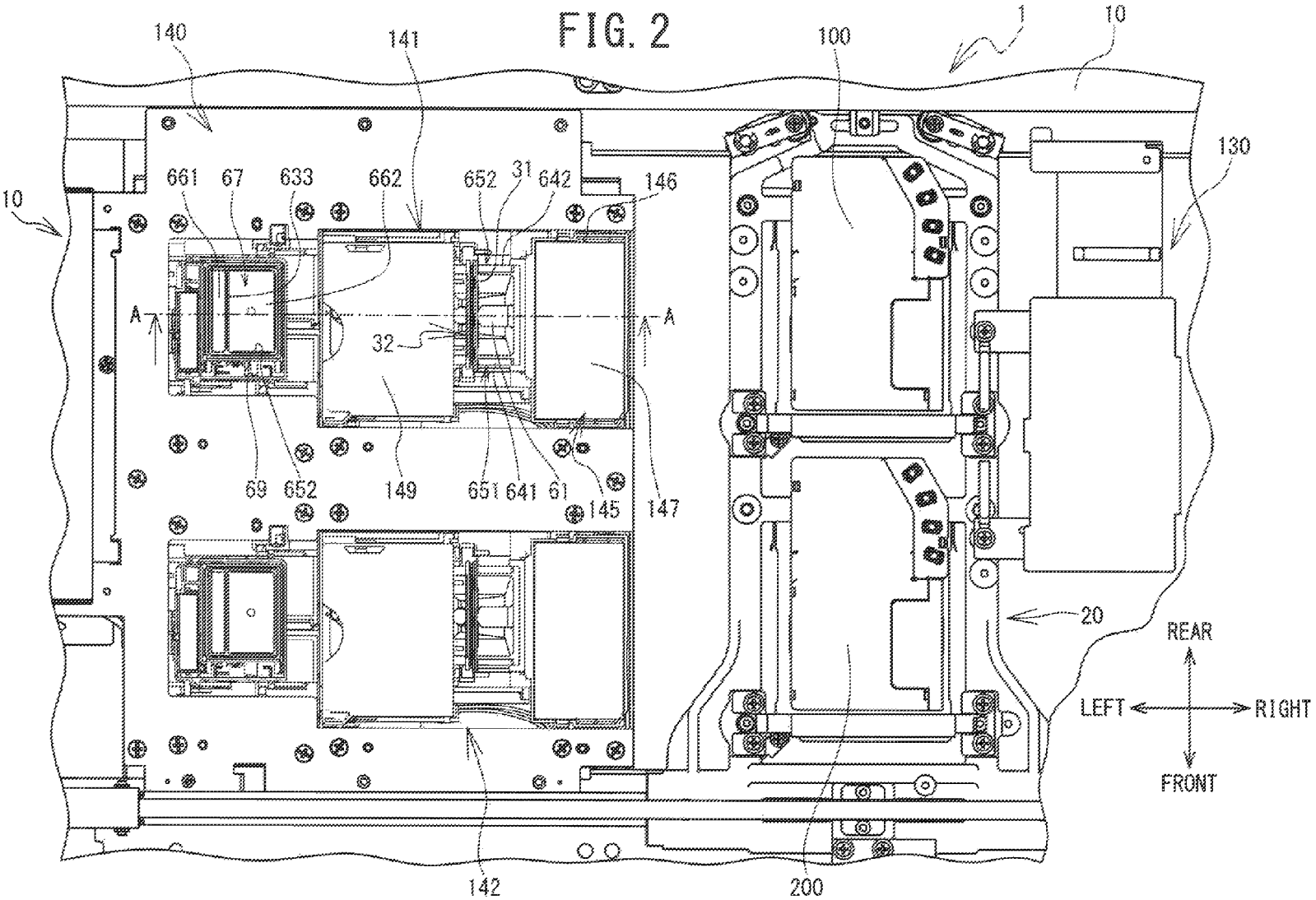
FIG. 2 is a plan view of the printer.
Figure 3:
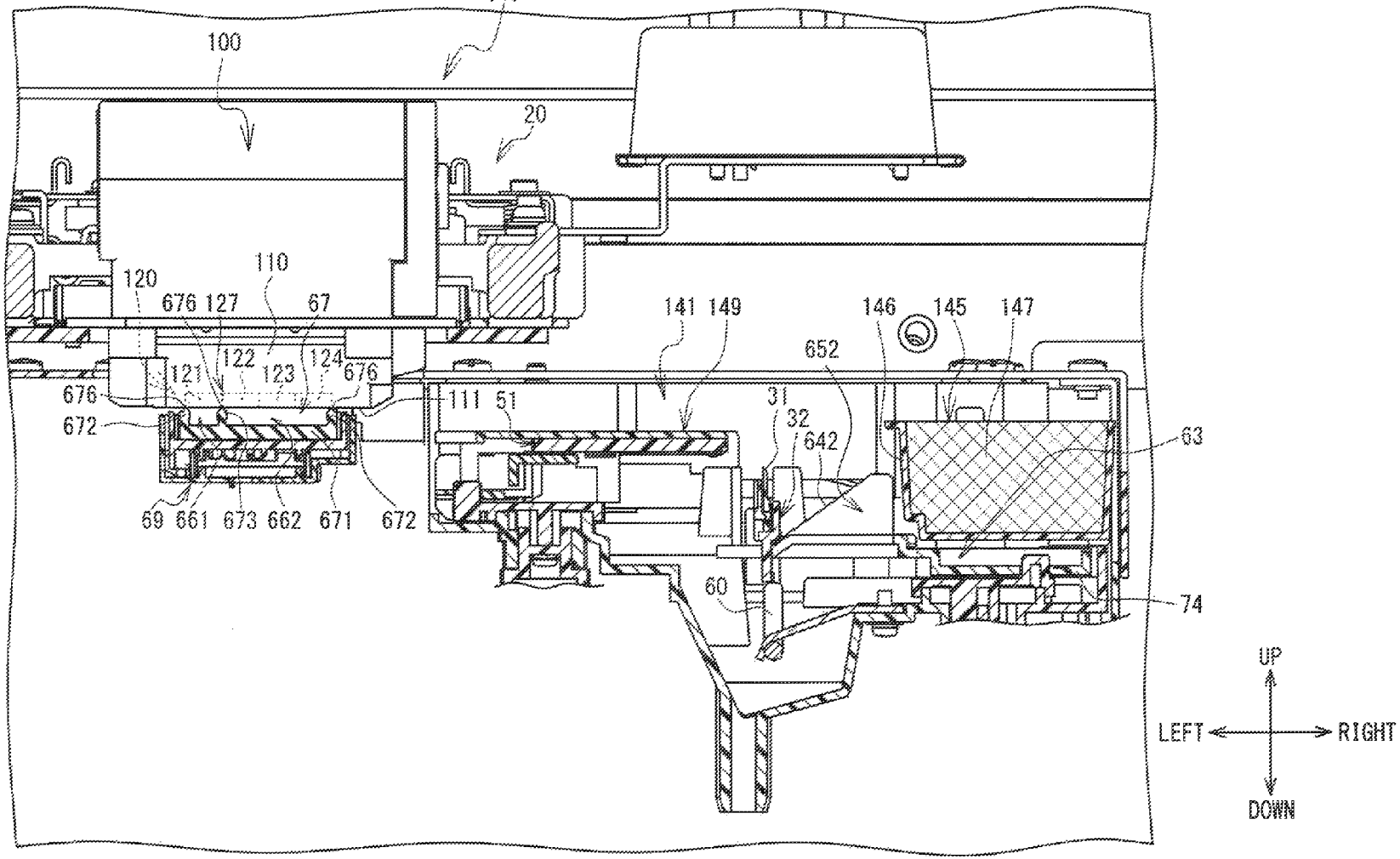
FIG. 3 is a cross-sectional view as seen in the direction of arrows along a line A-A shown in FIG. 2, where a wiper is in a wiper separation position, and a cap is in a covering position.

The carriage 20 is supported such that the carriage 20 can be conveyed in the left-right direction along the guide shaft 9. As shown in FIG. 1 and FIG. 2, the head units 100 and 200 are mounted on the carriage 20 such that the head units 100 and 200 are arranged in the front-rear direction. The head unit 100 is positioned further to the rear than the head unit 200. As shown in FIG. 3, a head portion 110 is provided on a bottom portion of each of the head units 100 and 200. The head portion 110 of the head unit 100 can eject the white ink. The head portion 110 of the head unit 200 can eject the color inks.

The head portion 110 includes a nozzle surface 111. The nozzle surface 111 is a surface that includes a plurality of fine nozzles that can eject the ink 91 downward. The nozzle surface 111 is a flat surface that is parallel to the horizontal direction. The nozzle surface 111 forms a bottom surface of each of the head units 100 and 200. On the nozzle surface 111, the plurality of nozzles are provided in a nozzle arrangement area 120. The nozzle arrangement area 120 is provided in a central portion of the nozzle surface 111 in the left-right direction, and extends in the front-rear direction.

The nozzle surface 111 includes a plurality of nozzle arrays 121 to 124 in each of which the plurality of nozzles are arrayed. Each of the nozzle arrays 121 to 124 is an array of a plurality of the nozzles. The nozzle arrays 121 to 124 are respectively positioned in four areas into which the nozzle arrangement area 120 is divided in the left-right direction. The nozzle array 121, the nozzle array 122, the nozzle array 123, and the nozzle array 124 are aligned in that order from the left side to the right side.

The nozzle arrays 121 to 124 of the head unit 100 can each eject white ink. The nozzle arrays 121 and 122 of the head unit 100 are connected, via mutually different white ink supply tubes (not shown in the drawings), to a single cartridge (not shown in the drawings) that stores white ink.

The nozzle arrays 123 and 124 of the head unit 100 are connected, via mutually different white ink supply tubes (not shown in the drawings), to another cartridge that stores white ink.

The nozzle arrays 121 to 124 of the head unit 200 are connected, via mutually different color ink supply tubes (not shown in the drawings), to ink cartridges (not shown in the drawings) that store color inks corresponding to the respective colors. Specifically, the nozzle array 121 is connected to an ink cartridge of black ink. The nozzle array 122 is connected to an ink cartridge of yellow ink. The nozzle array 123 is connected to an ink cartridge of cyan ink. The nozzle array 124 is connected to an ink cartridge of magenta ink.

As shown in FIG. 1, the drive belt 101 is strip-shaped, and is arranged along the left-right direction on the inside of the frame body 10. The drive belt 101 is made of flexible resin. The drive motor 19 is provided on a front right portion on the inside of the frame body 10. The drive motor 19 can rotate in the forward direction and the reverse direction. The drive motor 19 is coupled to the carriage 20 via the drive belt 101. When the drive motor 19 drives the drive belt 101, the carriage 20 is reciprocated in the left-right direction along the guide shaft 9. The head units 100 and 200 are thus reciprocated in the left-right direction. The head units 100 and 200 can eject the ink 91 toward the platen 5 that is positioned below the head units 100 and 200 such that the platen 5 is opposed to the head units 100 and 200. Printing can thus be performed on the print medium supported by the platen 5.

The platen drive mechanism 6 includes the pair of guide rails (not shown in the drawings) and a platen support base (not shown in the drawings). The pair of guide rails extend in the front-rear direction on the inside of the platen drive mechanism 6. The pair of guide rails support the platen support base such that the platen support base can move in the front-rear direction. The upper portion of the platen support base supports the platen 5. The platen 5 may support the print medium.

The tray 4 is provided below the platen 5. The tray 4 may receive a sleeve or the like of a T-shirt that is placed on the platen 5, and may thus protect the sleeve or the like such that the sleeve or the like does not come into contact with a component inside the housing 2.

The platen drive mechanism 6 is driven by a sub-scanning drive portion 46 (refer to FIG. 6), which will be described below, and moves the platen support base and the platen 5 along the pair of guide rails in the front-rear direction of the housing 2. Printing by the printer 1 on the print medium may be performed by the platen 5 conveying the print medium in the front-rear direction (a sub-scanning direction) and the ink 91 being ejected from the head portion 110 that is reciprocated in the left-right direction.

As shown in FIG. 1 and FIG. 2, in the present embodiment, the carriage 20 is disposed on the inside of the frame body 10. Therefore, the head portion 110 (refer to FIG. 3) can be moved in the left-right direction between a left end portion and a right end portion on the inside of the frame body 10. On a movement path of the head portion 110, an area in which printing is performed by the head portion 110 is referred to as a printing area 130. An area, on the movement path of the head portion 110, other than the printing area 130 is referred to as a non-printing area 140. The non-printing area 140 is an area of a left portion of the printer 1. The printing area 130 is an area from the right side of the non-printing area 140 to a right end portion of the printer 1. The platen 5, the tray 4, and the like are provided in the printing area 130.

In the present embodiment, various maintenance operations to secure the print quality are executed in the non-printing area 140. The maintenance operations includes a flushing operation, an ink purge operation, a cleaning operation, a nozzle surface wiping operation, and a wiper wiping operation, for example. The flushing operation is an operation in which, before the printing is performed on the print medium, the ink 91 is ejected from the head portion 110 onto a flushing receiving portion 145 (refer to FIG. 2), which will be described below. As a result of performing the flushing operation, the ink 91 may be ejected appropriately from the head portion 110 immediately after printing is started. The ink purge operation is an operation (refer to FIG. 10) in which the ink 91 is drawn out from the nozzles by a suction pump 708, which will be described below, in a state in which the nozzles of the nozzle surface 111 are covered by a cap 67 (refer to FIG. 2), which will be described below. As a result of performing the ink purge operation, for example, air bubbles entered inside the nozzles may be discharged along with the ink 91. In this way, it is possible to reduce the possibility of the occurrence of an ejection defect as a result of air bubbles. The cleaning operation is an operation (refer to FIG. 12) in which the nozzle surface 111 to which the ink 91 is attached is cleaned by using a cleaning fluid 92.

The nozzle surface wiping operation is an operation (refer to FIG. 4) in which the excessive ink 91 and cleaning fluid 92 on the surface of the nozzle surface 111 are wiped by a wiper 31, which is described below. As a result of performing the nozzle surface wiping operation, for example, it is possible to reduce the possibility that the ink 91 remaining on the nozzle surface 111 becomes firmly attached to the nozzle surface 111 and it becomes difficult to eject the ink 91 from the nozzle surface 111. The wiper wiping operation is an operation (refer to FIG. 5) in which the ink 91 attached to the wiper 31 is wiped away by an absorption member 51, which will be described below. For example, the ink 91 and the cleaning fluid 92 wiped from the nozzle surface 111 may be attached to the wiper 31. In this case, as a result of performing the wiper wiping operation, when the next nozzle surface wiping operation is performed, it is possible to reduce the possibility of the ink 91 and the cleaning fluid 92 becoming attached to the nozzle surface 111 from the wiper 31.

As shown in FIG. 2, maintenance portions 141 and 142 are provided in the non-printing area 140. The maintenance portions 141 and 142 are respectively positioned below the movement paths of the head units 100 and 200. By the control of a CPU 40 (refer to FIG. 6) of the printer 1, in the maintenance portions 141 and 142, maintenance operations are performed on the head units 100 and 200. The configuration and the operation of the maintenance portion 141 are the same as those of and the maintenance portion 142. Therefore, in the following explanation, the maintenance portion 141 will be explained.

As shown in FIG. 2 and FIG. 3, the maintenance portion 141 includes the wiper 31, the flushing receiving portion 145, the absorption member 51, a support plate 149, the cap 67, and a cap support portion 69. As shown in FIG. 3, the flushing receiving portion 145 is positioned on a right portion, of the maintenance portion 141, above a wall portion 74 of a movement portion 63, which will be described below. The flushing receiving portion 145 includes a container portion 146 and an absorption body 147. The container portion 146 is a container that is rectangular in a plan view and that is open at the top. The absorption body 147 is disposed inside the container portion 146. The absorption body 147 is a cuboid member that can absorb the ink 91. The flushing receiving portion 145 may receive the ink 91 that is ejected from the head unit 100 by the flushing operation. The ink 91 may be absorbed by the absorption body 147.

As shown in FIG. 2 and FIG. 3, the wiper 31 is provided to the left of the flushing receiving portion 145. The wiper 31 can be moved in the up-down direction. As shown in FIG. 3, in the up-down direction, the wiper 31 is provided below the nozzle surface 111. The wiper 31 extends in the front-rear direction. The upper end of the wiper 31 is parallel to the nozzle surface 111. A wiper support portion 32 is provided below the wiper 31 and supports the wiper 31. The wiper support portion 32 is a rectangular shape that is long in the front-rear direction when seen from the left side, and has a specified width in the left-right direction. The movement portion 63 is provided with inclined portions 641 and 642, which will be described below. A lower portion of the wiper support portion 32 is in contact with inclined portions 641 and 642 such that the wiper support portion 32 can be moved with respect to the inclined portions 641 and 642. A coil spring 60 is fixed to the lower portion of the wiper support portion 32. The wiper support portion 32 is urged downward by the coil spring 60.

As shown in FIG. 2 and FIG. 3, the movement portion 63 includes opposing wall portions 651 and 652, and the wall portion 74 (refer to FIG. 3). The pair of opposing wall portions 651 and 652 are opposed to each other in the front-rear direction. Each of the pair of opposing wall portion 651 and 652 is a substantially triangular shape in a side view. The opposing wall portions 651 and 652 respectively include the inclined portions 641 and 642.

The pair of inclined portions 641 and 642 are opposed to each other in the front-rear direction. The pair of inclined portions 641 and 642 respectively form upper portions of the opposing wall portions 651 and 652, and are portions that extend downward and diagonally to the left. As shown in FIG. 3, the wall portion 74 is a wall portion that is rectangular in a plan view and that is connected to right end portions of lower portions of the opposing wall portions 651 and 652. The wall portion 74 is connected to a second drive portion 195 (refer to FIG. 6), which will be described below. The movement portion 63 can be moved in the left-right direction as a result of driving of the second drive portion 195. The wiper support portion 32 can be moved in the up-down direction along the inclined portions 641 and 642 in accordance with the movement of the movement portion 63 in the left-right direction.

As shown in FIG. 3, a position of each of the wiper 31 and the wiper support portion 32 in the up-down direction in which the wiper 31 is separated from the nozzle surface 111 and the absorption member 51 is referred to as a wiper separation position. In the wiper separation position, the wiper support portion 32 is in contact with the lower end portions of the inclined portions 641 and 642.

Figure 4:
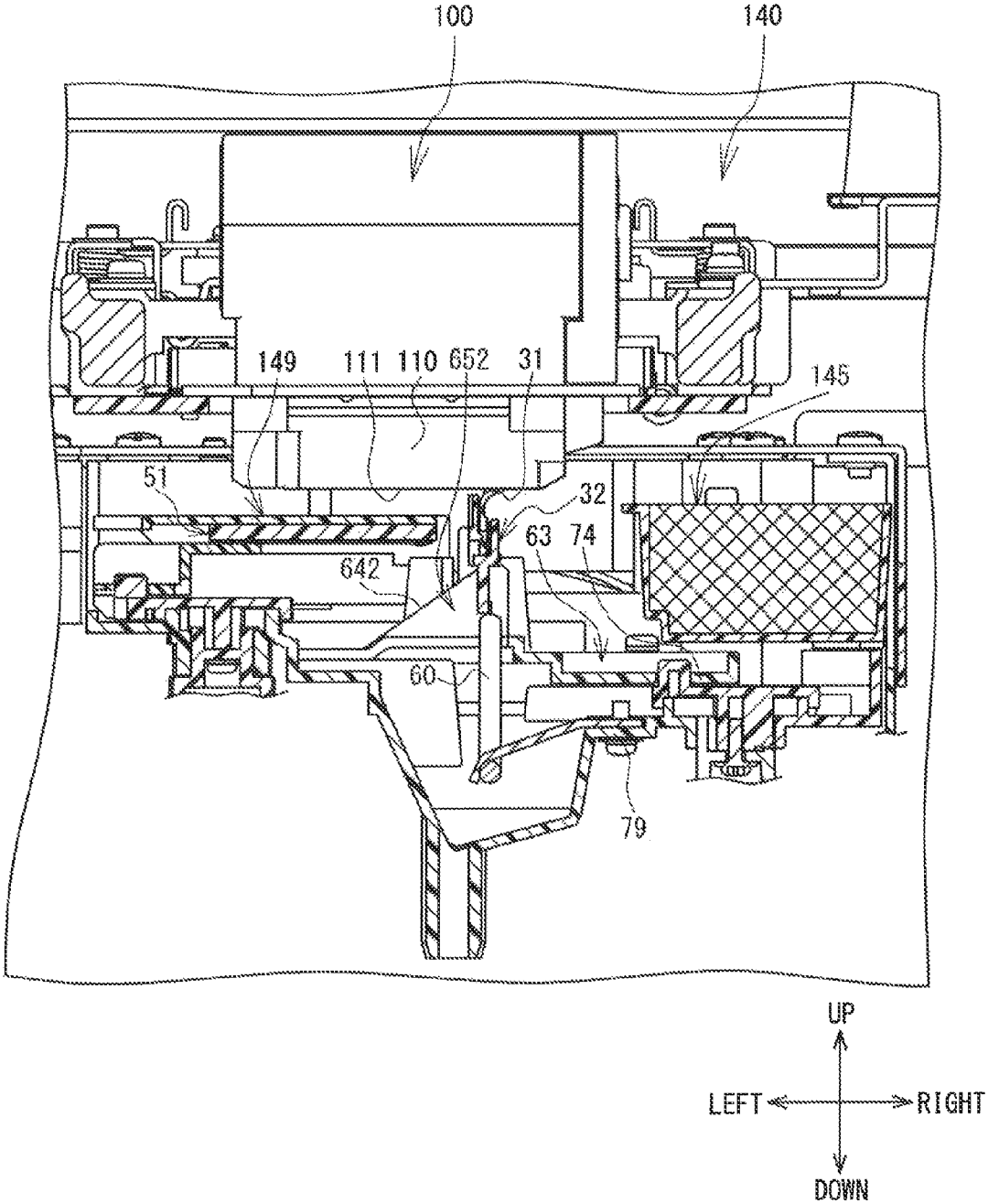
FIG. 4 is a cross-sectional view showing a state in which the wiper is in a first contact position and a nozzle surface wiping operation is being performed.

As shown in FIG. 4, a position of the wiper 31 and the wiper support portion 32 in the up-down direction in which the wiper 31 can come into contact with the nozzle surface 111 is referred to as a first contact position. In the first contact position, the wiper support portion 32 is in contact with the upper end portions of the inclined portions 641 and 642. When the carriage 20 moves to the right in a state in which the wiper 31 and the wiper support portion 32 are in the first contact position, the wiper 31 slides in contact with the nozzle surface 111. In this manner, the ink 91 and the cleaning fluid 92 may be removed from the nozzle surface 111. The nozzle surface wiping operation is thus performed.

Figure 5:
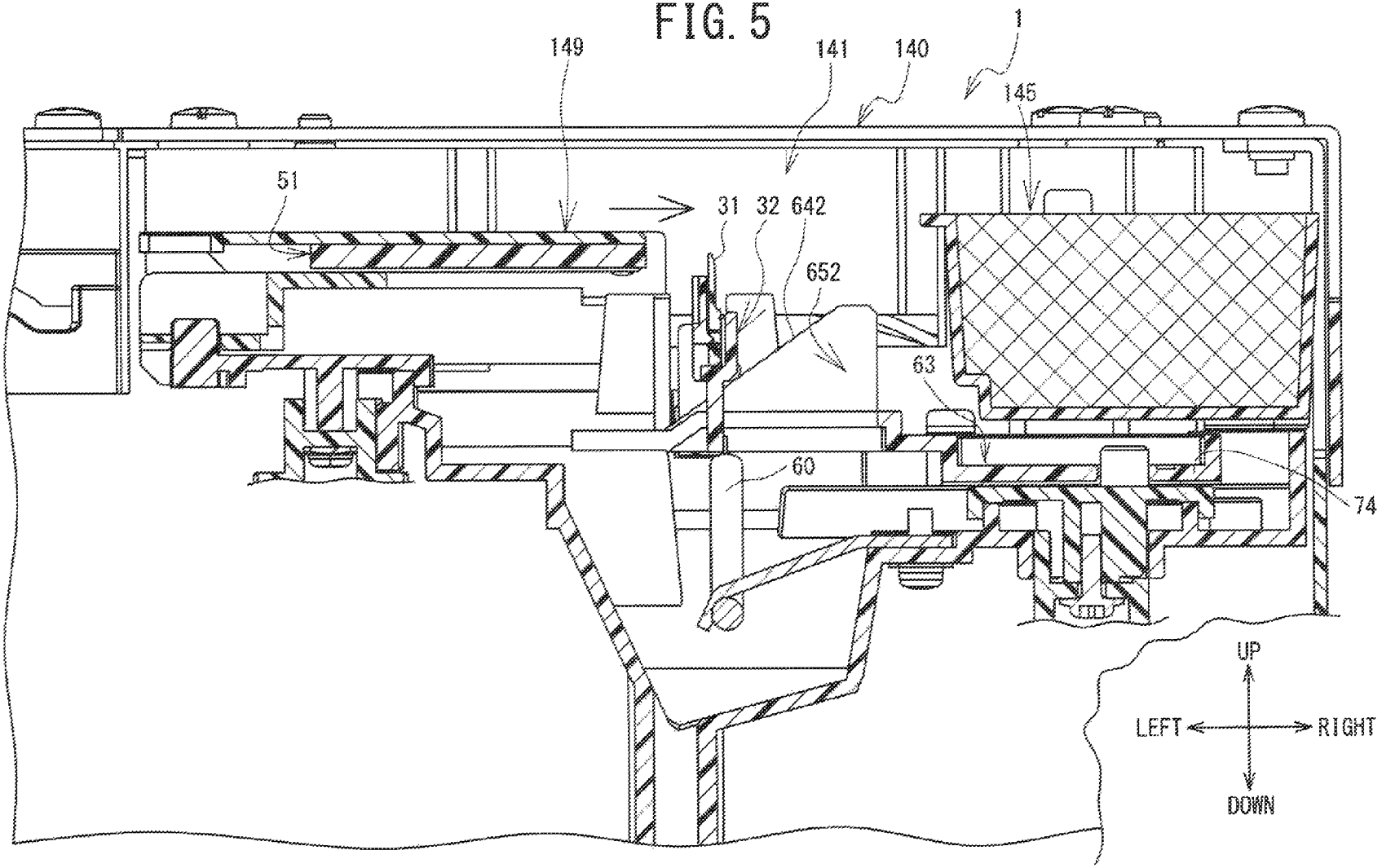
FIG. 5 is a cross-sectional view showing a state in which the wiper is in a second contact position.

As shown in FIG. 5, a position of each of the wiper 31 and the wiper support portion 32 in the up-down direction in which the wiper 31 can come into contact with the absorption member 51 is referred to as a second contact position. In the second contact position, the wiper support portion 32 is in contact with portions of the inclined portions 641 and 642 that are slightly to the lower side than the center of the inclined portions 641 and 642 in the up-down direction.

The support plate 149 is provided between the wiper 31 and the cap 67 in the left-right direction. The support plate 149 is a plate-shaped member that is rectangular in a plan view and that extends in the horizontal direction. As shown in FIG. 3, the absorption member 51 is attached to the bottom surface of the support plate 149, and is supported by the support plate 149. The absorption member 51 is plate-shaped and extends in the horizontal direction. The absorption member 51 can absorb the ink 91 and the cleaning fluid 92.

Figure 6:
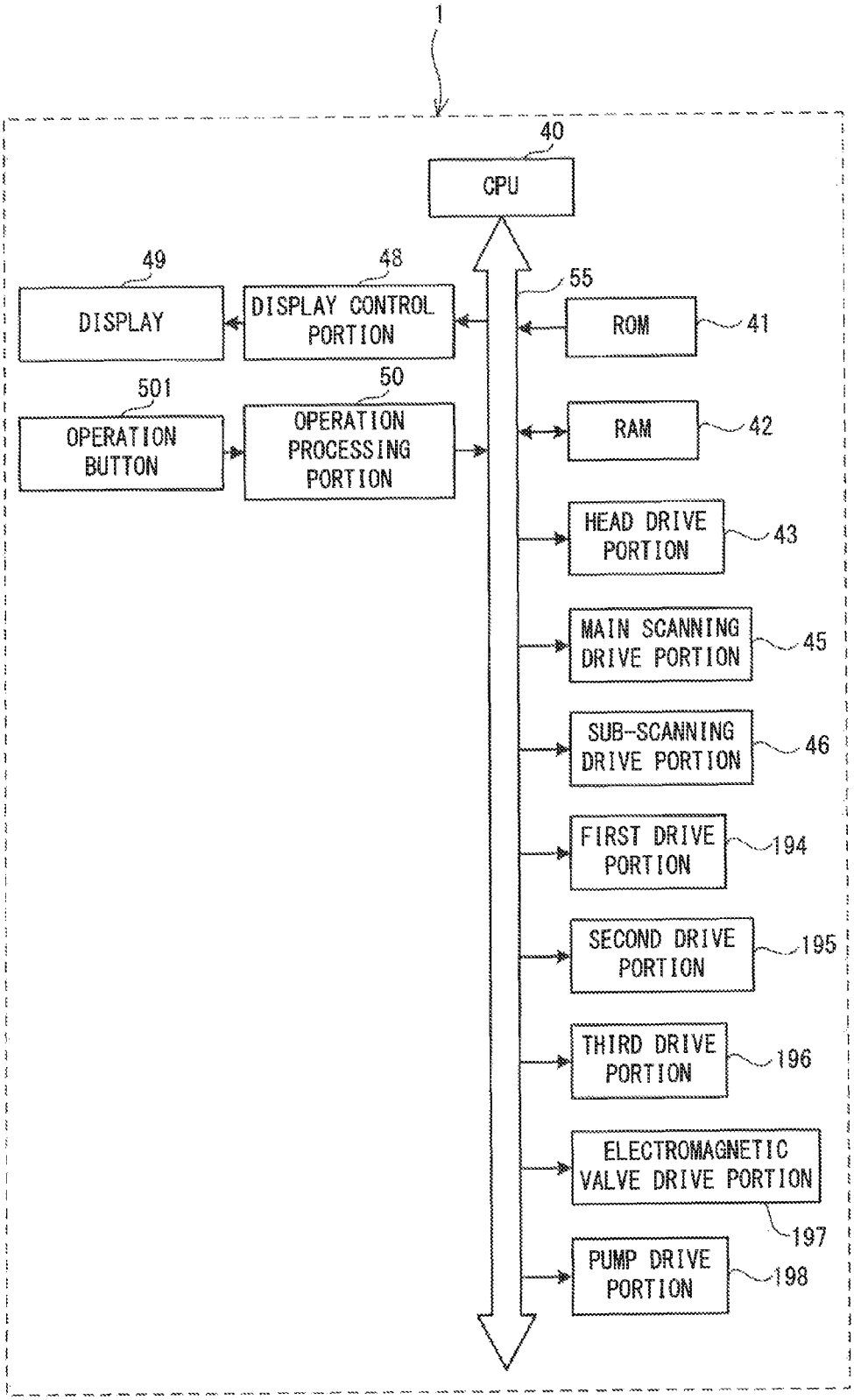
FIG. 6 is a block diagram showing an electrical configuration of the printer.

The support plate 149 is moved in the left-right direction by the driving of a first drive portion 194 (refer to FIG. 6). When the support plate 149 is moved to the right in a state in which the wiper 31 and the wiper support portion 32 are in the second contact position, the wiper 31 slides in contact with the bottom surface of the absorption member 51. In this manner, the absorption member 51 may absorb and remove the ink 91 and the cleaning fluid 92 that are attached to the wiper 31. The wiper wiping operation is thus performed.

As shown in FIG. 2 and FIG. 3, the cap 67 and the cap support portion 69 are provided on a left portion of the maintenance portion 141. The cap 67 is included in a maintenance flow path system 700 (refer to FIG. 7), which will be described below. The cap support portion 69 is a box shape that is rectangular in a plan view and its upper surface is open. The cap 67 is disposed inside the cap support portion 69.

The cap 67 is formed, for example, by a synthetic resin, such as rubber or the like. The cap 67 includes a bottom wall 671, a peripheral wall 672, and a partition wall 673. The bottom wall 671 is a plate-shaped wall portion that forms a lower portion of the cap 67 and that extends in the horizontal direction. The bottom wall 671 has a rectangular shape that corresponds to an inner surface of the cap support portion 69 in a plan view. The peripheral wall 672 is a wall portion that is provided on an upper side, namely on the nozzle surface 111 side, of the cap 67. The peripheral wall 672 extends upward from around the periphery of the bottom wall 671. In the up-down direction, the peripheral wall 672 is opposed to the periphery of the nozzle arrangement area 120 of the nozzle surface 111.

The partition wall 673 is a wall portion that is provided on the upper side, namely on the nozzle surface 111 side, of the cap 67. The partition wall 673 extends upward from the bottom wall 671. The partition wall 673 is provided between the center of the bottom wall 671 in the left-right direction and the left end portion of the bottom wall 671, and extends in the front-rear direction. The front end and the rear end of the partition wall 673 are connected to a front end portion and a rear end portion of the peripheral wall 672, respectively. In the up-down direction, the partition wall 673 is opposed to a boundary 127 between the nozzle array 121 and the nozzle arrays 122 to 124. Cap lips 676, which form the top ends of the peripheral wall 672 and of the partition wall 673, have the same height in the up-down direction. The cap lips 676 are positioned above the top end of the cap support portion 69.

An area inside the peripheral wall 672 is divided into two by the partition wall 673. In the following explanation, of the areas inside the peripheral wall 672, an area on the left side of the partition wall 673 is referred to as a first area 661 and an area on the right side of the partition wall 673 is referred to as a second area 662.

Figure 9:
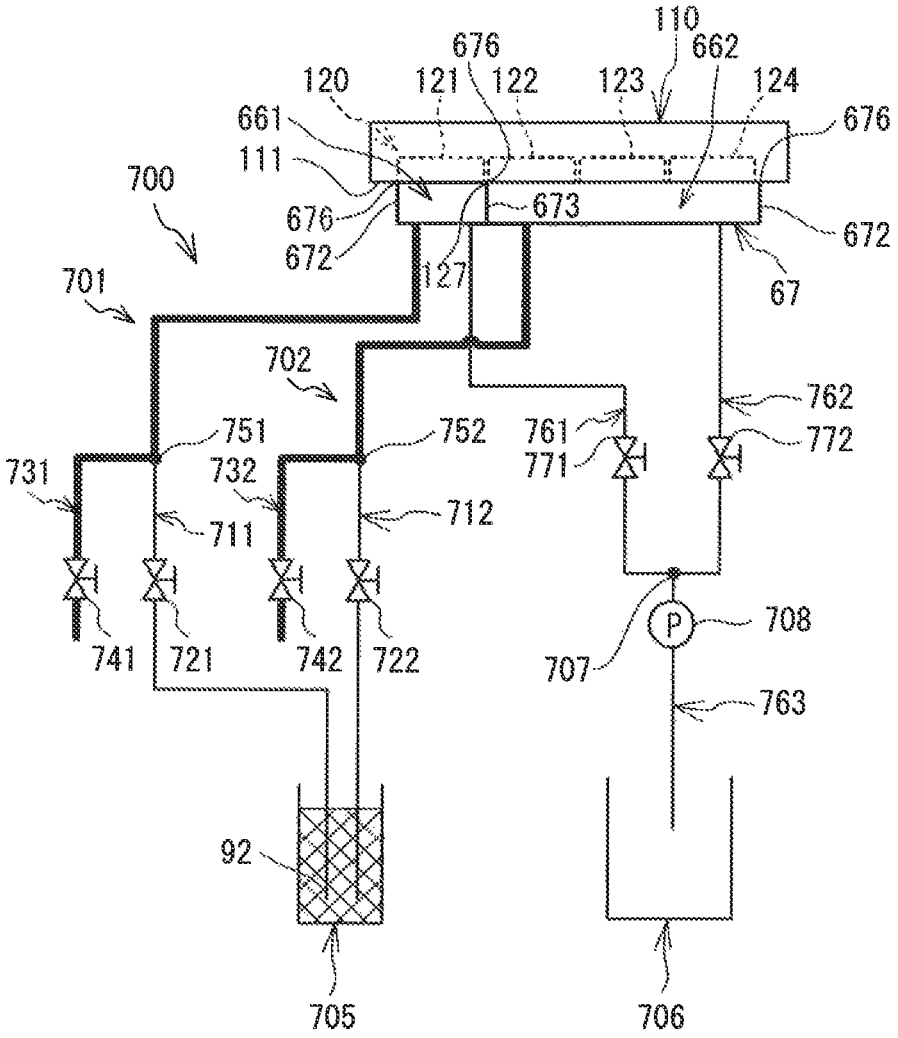
FIG. 9 is a schematic diagram of the maintenance flow path system showing a state in which the cap is in the covering position.

By the driving of a third drive portion 196 (refer to FIG. 6), which will be described below, the cap support portion 69 is moved in the up-down direction between a covering position (refer to FIG. 3 and FIG. 9) and a cap separation position (refer to FIG. 7 and FIG. 16). The covering position is a position of each of the cap 67 and the cap support portion 69 in which the cap 67 fits closely to the nozzle surface 111 and covers the nozzles. The cap separation position is a position in which the cap 67 is separated from and below the nozzle surface 111. As shown in FIG. 3 and FIG. 9, when the cap 67 and the cap support portion 69 are in the covering position, the peripheral wall 672 fits closely to the periphery of the nozzle arrangement area 120 of the nozzle surface 111, and the partition wall 673 fits closely to the boundary 127 of the nozzle surface 111. The ink purge operation, the cleaning operation, and the like are performed when the cap 67 and the cap support portion 69 are in the covering position.

An electrical configuration of the printer 1 will be explained with reference to FIG. 6. The printer 1 includes the CPU 40, which controls the printer 1. A ROM 41, a RAM 42, a head drive portion 43, a main scanning drive portion 45, the sub-scanning drive portion 46, the first drive portion 194, the second drive portion 195, the third drive portion 196, an electromagnetic valve drive portion 197, a pump drive portion 198, a display control portion 48, and an operation processing portion 50 are electrically connected to the CPU 40 via a bus 55.

The ROM 41 stores a control program, initial values, and the like that are used by the CPU 40 to control the operations of the printer 1. The RAM 42 temporarily stores various data that is used in the control program. The head drive portion 43 is electrically connected to the head portions 110, which is configured to eject the ink 91. The head drive portion 43 is configured to drive piezoelectric elements provided on ejection channels of the head portions 110 (refer to FIG. 3) and cause the ink 91 to be ejected from the nozzles.

The main scanning drive portion 45 includes the drive motor 19 (refer to FIG. 1). The main scanning drive portion 45 is configured to move the carriage 20 in the left-right direction (a main scanning direction). The sub-scanning drive portion 46 includes a motor and gears that are not shown in the drawings. The sub-scanning drive portion 46 is configured to drive the platen drive mechanism 6 (refer to FIG. 1) and moves the platen 5 (refer to FIG. 1) in the front-rear direction (the sub-scanning direction).

The first drive portion 194 includes a first drive motor (not shown in the drawings), gears (not shown in the drawings), and the like. The first drive portion 194 is configured to move the support plate 149 in the left-right direction. Thus, the first drive portion 194 can move the absorption member 51 in the left-right direction. The second drive portion 195 includes a second drive motor (not shown in the drawings), gears (not shown in the drawings), the movement portion 63 (refer to FIG. 3), and the like. The second drive portion 195 is configured to move the wiper support portion 32 in the up-down direction. Thus, the second drive portion 195 can move the wiper 31 in the up-down direction. The third drive portion 196 includes a third drive motor (not shown in the drawings), gears (not shown in the drawings), and the like. The third drive portion 196 is configured to move the cap support portion 69 in the up-down direction. Thus, the third drive portion 196 can move the cap 67 in the up-down direction. Further, the third drive portion 196 is configured to tilt the cap support portion 69 with respect to the horizontal plane. Thus, the third drive portion 196 can tilt the cap 67 with respect to the nozzle surface 111 (refer to FIG. 14). When tilting the cap support portion 69 with respect to the nozzle surface 111, for example, the third drive portion 196 may drive an actuator that is not shown in the drawings to pull the left end portion of the cap support portion 69 downward. In this manner, the third drive portion 196 may tilt the cap support portion 69 diagonally downward to the left. The cap support portion 69 may be tilted using another configuration. The cap 67 is tilted in the left-right direction in FIG. 14, but the cap 67 may be tilted in the front-rear direction.

The electromagnetic valve drive portion 197 is configured to open and close supply opening/closing valves 721 and 722, gas opening/closing valves 741 and 742, and waste fluid opening/closing valves 771 and 772 (refer to FIG. 7), which will be described below. The pump drive portion 198 is configured to drive the suction pump 708 (refer to FIG. 7), which will be described below. The display control portion 48 is configured to control display of the display 49. The operation processing portion 50 is configured to output, to the CPU 40, an operation input with any one of the operation buttons 501.

The maintenance flow path system 700 will be explained with reference to FIG. 7. In FIG. 7, in order to make the drawing easier to understand, the maintenance flow path system 700 and the head portion 110 are illustrated schematically. The maintenance flow path system 700 is a mechanism through which the ink 91, the cleaning fluid 92, and air flow when maintenance processing (refer to FIG. 8), which will be described below, is performed. The maintenance flow path system 700 includes a cleaning fluid tank 705, supply flow paths 711 and 712, the supply opening/closing valves 721 and 722, gas channels 731 and 732, the gas opening/closing valves 741 and 742, waste fluid flow paths 761, 762, and 763, the waste fluid opening/closing valves 771 and 772, the suction pump 708, and a waste fluid tank 706.

The cleaning fluid tank 705 is a container in which the cleaning fluid 92 stored. The supply flow path 711 is a flow path that is connected to the first area 661 of the cap 67 and to the cleaning fluid tank 705. The supply flow path 711 can supply the cleaning fluid 92 that is stored in the cleaning fluid tank 705 to the first area 661 of the cap 67, by an operation of the suction pump 708, which will be described below. The supply flow path 712 is a flow path that is connected to the second area 662 of the cap 67 and to the cleaning fluid tank 705. The supply flow path 712 can supply the cleaning fluid 92 that is stored in the cleaning fluid tank 705 to the second area 662 of the cap 67, by an operation of the suction pump 708, which will be described below.

The supply opening/closing valves 721 and 722 are electromagnetic valves that are provided on the supply flow paths 711 and 712, respectively. The supply opening/closing valves 721 and 722 can open and close the supply flow paths 711 and 712, respectively. The gas channels 731 and 732 are connected to the supply flow paths 711 and 712, respectively, at confluence portions 751 and 752 that are positioned closer to the cap 67 than the supply opening/closing valves 721 and 722. Thus, the gas channel 731 is connected to the first area 661 of the cap 67 via the supply flow path 711. The gas channel 732 is connected to the second area 662 of the cap 67 via the supply flow path 712. Ends of the gas channels 731 and 732 on the opposite side to the cap 67 side are exposed to the air. The gas channels 731 and 732 are channels for air. The gas opening/closing valves 741 and 742 are electromagnetic valves that are provided on the gas channels 731 and 732, respectively. The gas opening/closing valves 741 and 742 open and close the gas channels 731 and 732, respectively.

The waste fluid flow path 761 is connected to the first area 661 of the cap 67. The waste fluid flow path 762 is connected to the second area 662 of the cap 67. The waste fluid flow paths 761 and 762 converge at a confluence portion 707, and thus become the one waste fluid flow path 763. The waste fluid flow path 763 is connected to the waste fluid tank 706. The waste fluid tank 706 is a container that stores the ink 91 and the cleaning fluid 92 discharged from the cap 67. The suction pump 708 is provided on the waste fluid flow path 763. The ink 91 and the cleaning fluid 92 can be discharged from the cap 67 via the waste fluid flow paths 761, 762, and 763 by an operation of the suction pump 708. The waste fluid opening/closing valves 771 and 772 are electromagnetic valves that are provided on the waste fluid flow paths 761 and 762, respectively. The waste fluid opening/closing valves 771 and 772 can open and close the waste fluid flow paths 761 and 762, respectively.

In the following explanation, the supply flow path 711, the gas channel 731, and the waste fluid flow paths 761 and 763 that are connected to the first area 661 are referred to as a first flow path system 701. The supply flow path 712, the gas channel 732, and the waste fluid flow paths 762 and 763 that are connected to the second area 662 are referred to as a second flow path system 702.

The maintenance processing will be explained with reference to FIG. 8. In the maintenance processing, the ink purge operation, the cleaning operation, the nozzle surface wiping operation, the wiper wiping operation, and the like are performed. The CPU 40 reads out the control program stored in the ROM 41, controls the printer 1 and performs the maintenance processing (refer to FIG. 8).

Figure 7:
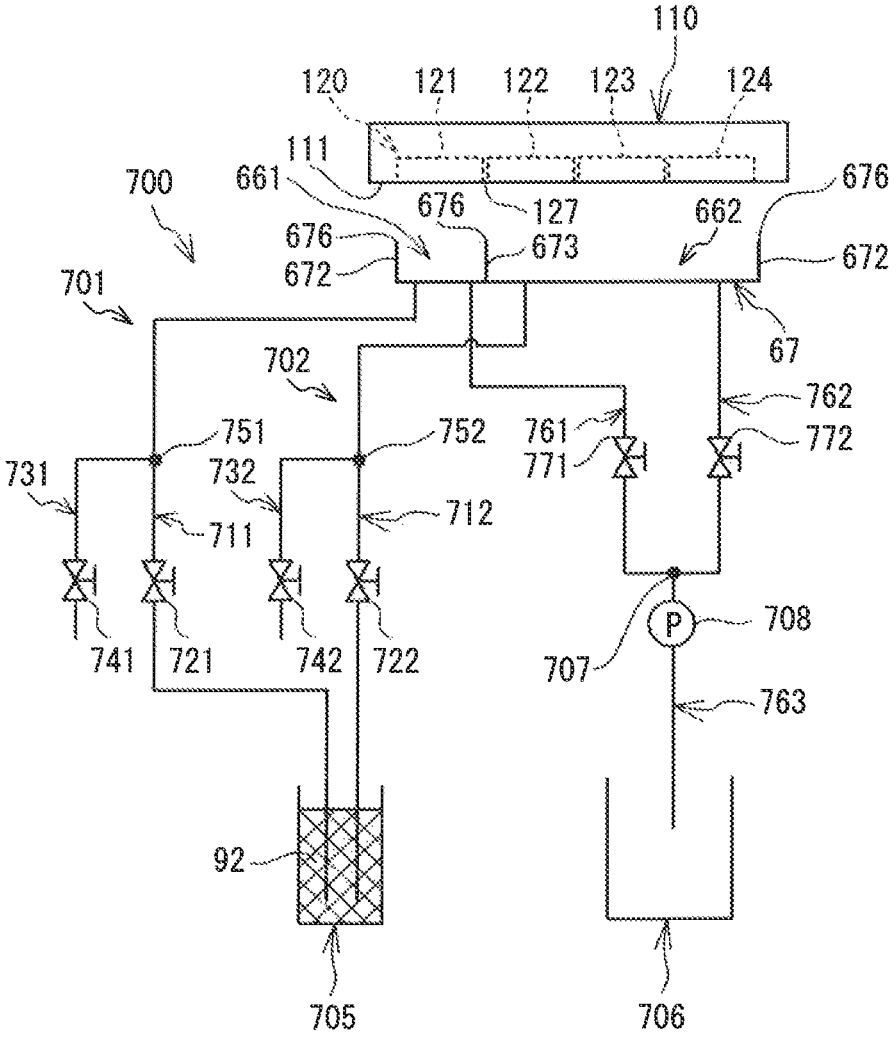
FIG. 7 is a schematic diagram of a maintenance flow path system in a state in which the cap is in a cap separation position.

As shown in FIG. 7, it is assumed that the cap 67 is in the cap separation position. Further, as shown in FIG. 3, it is assumed that the wiper 31 is in the wiper separation position. The CPU 40 drives the third drive portion 196 (refer to FIG. 6) and moves the cap support portion 69 upward, thus moving the cap 67 from the cap separation position (refer to FIG. 7) to the covering position (refer to FIG. 3 and FIG. 9) (step S1). In this way, the nozzle surface 111 is set to a covered state. In the covered state, the cap 67 covers the nozzle surface 111. A case is assumed, for example, in which, when the processing at step S1 is performed, the gas opening/closing valves 741 and 742 are closed. In this case, when the cap 67 is pressed against the nozzle surface 111, the air inside the first area 661 and the second area 662 is compressed and a repulsive force is generated. Thus, it may become difficult for the cap 67 to fit closely to the nozzle surface 111. Therefore, in the present embodiment, when the processing at step S1 is performed, the CPU 40 causes the gas opening/closing valves 741 and 742 to open such that the first area 661 and the second area 662 communicate with the air, as shown in FIG. 9. In this way, it is easier for the air inside the first area 661 and the second area 662 to escape to the outside via the gas channels 731 and 732. As a result, the cap 67 fits closely to the nozzle surface 111 in a smooth manner. The gas opening/closing valves 741 and 742 may remain closed.

In FIG. 9, the flow paths that are open by opening the gas opening/closing valves 741 and 742 are indicated by bold lines in comparison to the other flow paths. Although not particularly explained below, in FIG. 10 to FIG. 16 (to be described below) also, the flow paths that are open by the opening of the electromagnetic valves are indicated by bold lines.

As shown in FIG. 9, in the covered state, the peripheral wall 672 fits closely to the periphery of the nozzle arrangement area 120 on which the nozzles are arrayed. Further, in the covered state, the partition wall 673 fits closely to the boundary 127 between the nozzle array 121 and the nozzle arrays 122 to 124. Thus, the nozzle array 121 is disposed inside the first area 661 and the nozzle arrays 122 to 124 are disposed inside the second area 662.

Next, processing from step S2 to step S10 is performed. At step S2 to step S10, after the first flow path system 701 is used and the ink purge operation, the cleaning operation, and the like are performed with respect to the first area 661, the nozzle surface wiping operation and the wiper wiping operation are performed. While the CPU 40 is performing the processing at step S2 to step S10, in a case where the second flow path system 702 is not specifically referred to, the supply opening/closing valve 722 and the waste fluid opening/closing valve 772, which are the electromagnetic valves positioned on the second flow path system 702, are constantly closed. The gas opening/closing valve 742 may be closed or may be open. Therefore, in the processing from step S2 to step S10 explained below, an explanation is omitted with respect to the control of the electromagnetic valves positioned on the second flow path system 702.

The CPU 40 causes the ink 91 inside the nozzles to be drawn out into the first area 661 of the cap 67 (step S2). As shown in FIG. 10, at step S2, the CPU 40 causes the supply opening/closing valve 721 and the gas opening/closing valve 741 to close and causes the waste fluid opening/closing valve 771 to open. The CPU 40 causes the suction pump 708 to be driven. The supply opening/closing valve 721 and the gas opening/closing valve 741 are closed, and thus a negative pressure is established inside the first area 661 when the suction pump 708 sucks the air inside the first area 661. Accordingly, the ink 91 inside the nozzle array 121 is drawn out into the first area 661 and the ink 91 is stored in the first area 661. Part of the ink 91 may flow to the side of the waste fluid tank 706 through the waste fluid flow paths 761 and 763.

Figure 11:
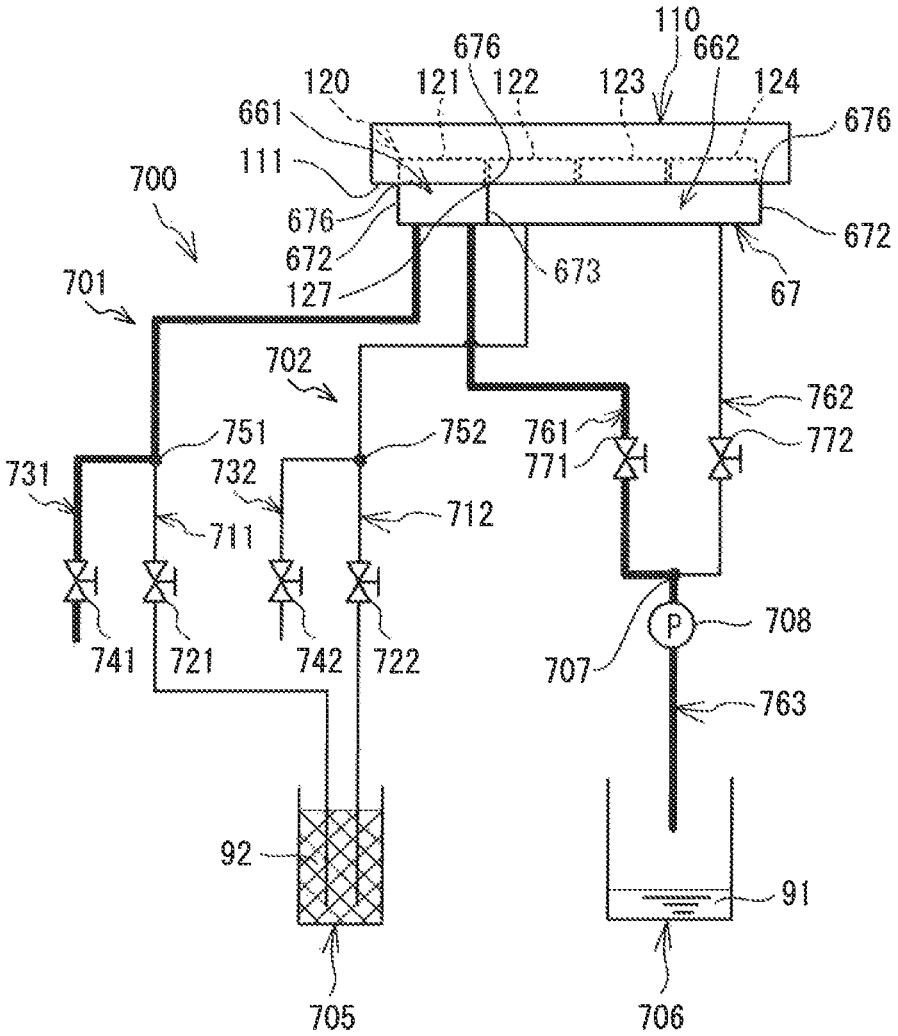
FIG. 11 is a schematic diagram of the maintenance flow path system showing a state in which the ink has been discharged from the first area.

Next, the CPU 40 causes the ink 91 drawn out of the nozzles at step S2 to be discharged via the waste fluid flow paths 761 and 763 (step S3). As shown in FIG. 11, at step S3, the CPU 40 causes the supply opening/closing valve 721 to close and causes the gas opening/closing valve 741 and the waste fluid opening/closing valve 771 to open. The CPU 40 causes the suction pump 708 to be driven. By the suction force of the suction pump 708, the air flows into the first area 661 via the gas channel 731, and the ink 91 inside the first area 661 is discharged into the waste fluid tank 706 via the waste fluid flow paths 761 and 763.

Figure 12:
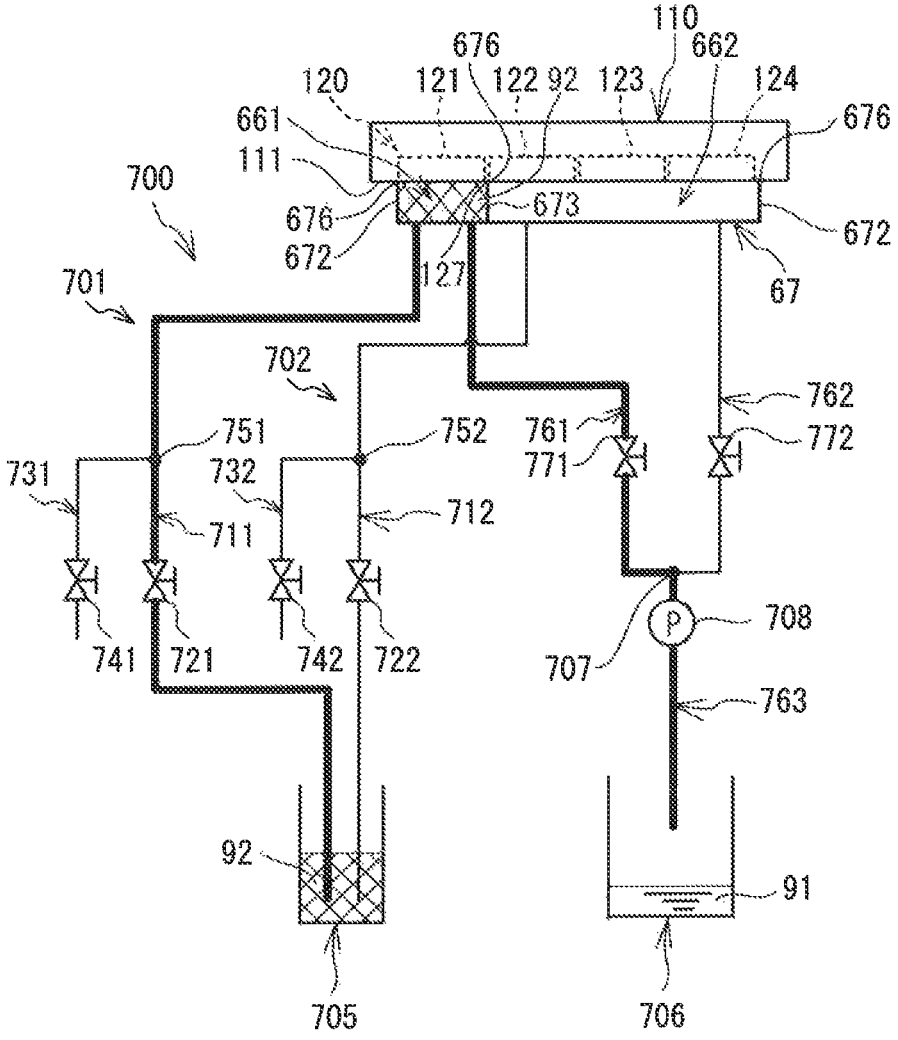
FIG. 12 is a schematic diagram of the maintenance flow path system showing a state in which cleaning fluid has been supplied to the first area.

Next, the CPU 40 causes the cleaning fluid 92 to be supplied from the cleaning fluid tank 705 to the first area 661 of the cap 67 via the supply flow path 711 (step S4). As shown in FIG. 12, at step S4, the CPU 40 causes the supply opening/closing valve 721 and the waste fluid opening/closing valve 771 to open and causes the gas opening/closing valve 741 to close. The CPU 40 causes the suction pump 708 to be driven. By the suction force of the suction pump 708, the cleaning fluid 92 flows from the cleaning fluid tank 705 to the first area 661 via the supply flow path 711. Accordingly, the first area 661 is filled with the cleaning fluid 92, and a portion in which the nozzle array 121 of the nozzle surface 111 is positioned and a portion inside the first area 661 of the cap 67 are cleaned by the cleaning fluid 92.

After the cleaning fluid 92 is supplied to the first area 661, the CPU 40 may cause the driving of the suction pump 708 to stop and may stand by for a specified period of time. In this case, while the CPU 40 is standing by, the cleaning by the cleaning fluid 92 is performed. Part of the cleaning fluid 92 that has flowed into the first area 661 may flow into the waste fluid tank 706 via the waste fluid flow paths 761 and 763.

Figure 13:
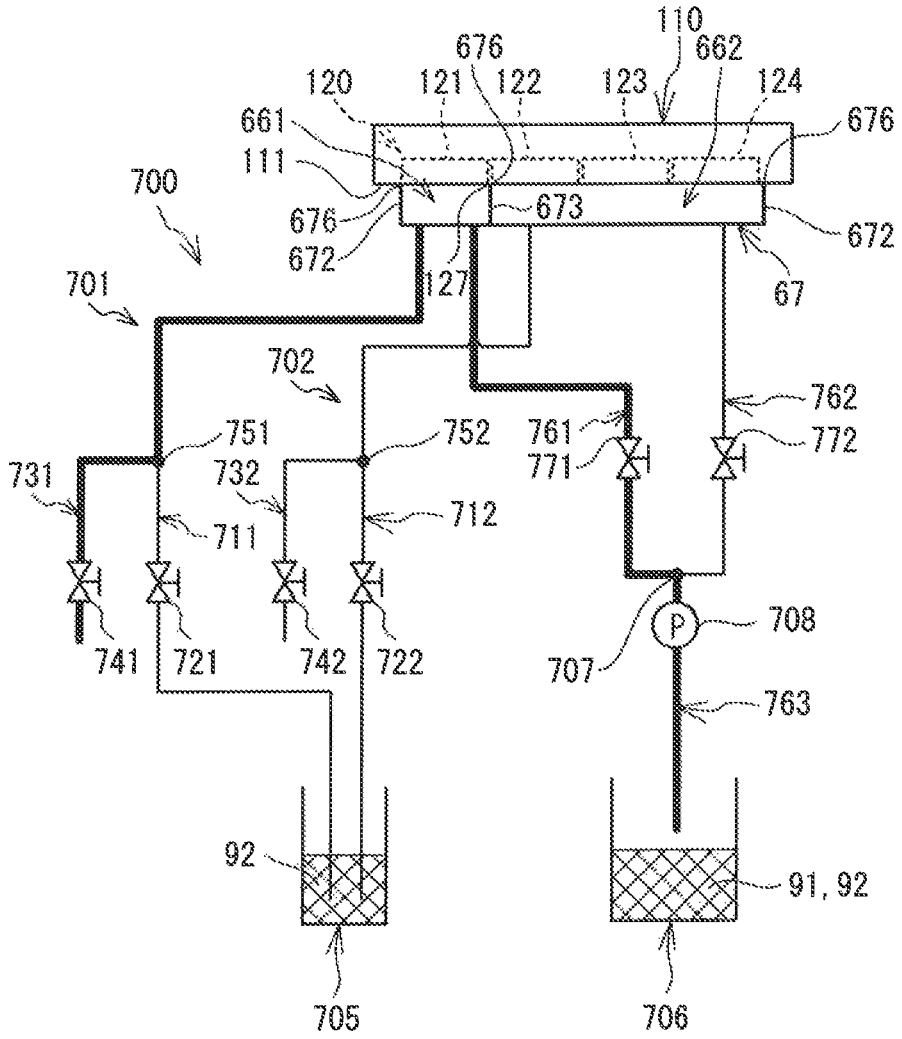
FIG. 13 is a schematic diagram of the maintenance flow path system showing a state in which the cleaning fluid has been discharged from the first area.

Next, the CPU 40 causes the cleaning fluid 92 to be discharged from the first area 661 via the waste fluid flow paths 761 and 763 (step S5). As shown in FIG. 13, at step S5, the CPU 40 causes the supply opening/closing valve 721 to close and causes the gas opening/closing valve 741 and the waste fluid opening/closing valve 771 to open. The CPU 40 causes the suction pump 708 to be driven. By the suction force of the suction pump 708, the air flows into the first area 661 via the gas channel 731, and the cleaning fluid 92 in the first area 661 is discharged to the waste fluid tank 706 via the waste fluid flow paths 761 and 763.

Figure 14:
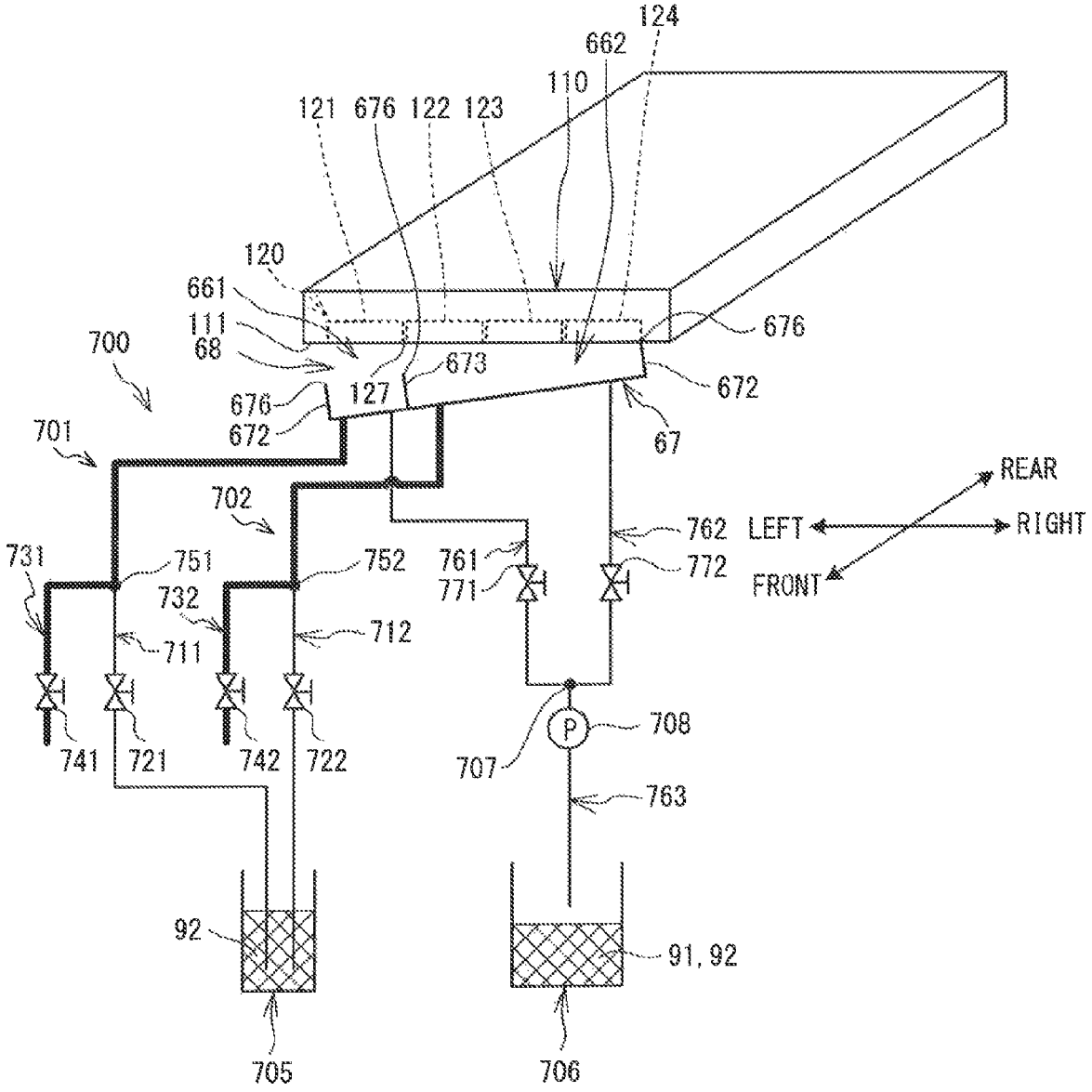
FIG. 14 is a schematic diagram of the maintenance flow path system showing a state in which the cap is tilted diagonally.

Next, the CPU 40 causes the third drive portion 196 (refer to FIG. 6) to be driven and causes the cap support portion 69 to be tilted diagonally with respect to the horizontal direction, causing the cap 67 to tilt with respect to the nozzle surface 111 (step S6). In this way, as shown in FIG. 14, a gap 68 is formed between the nozzle surface 111 and the periphery of the cap 67. A case is assumed, for example, in which, when the processing at step S6 is performed, the gas opening/closing valves 741 and 742 are closed. In this case, a negative pressure occurs when the cap 67 is pulled away from the nozzle surface 111, and it may become difficult for the cap 67 to tilt with respect to the nozzle surface 111. Therefore, in the present embodiment, when the processing at step S6 is performed, as shown in FIG. 14, the CPU 40 causes the gas opening/closing valves 741 and 742 to open, causing the first area 661 and the second area 662 to communicate with the air. In this way, it becomes difficult for the negative pressure to occur, and the cap 67 tilts smoothly with respect to the nozzle surface 111. The gas opening/closing valves 741 and 742 may remain closed.

Figure 15:
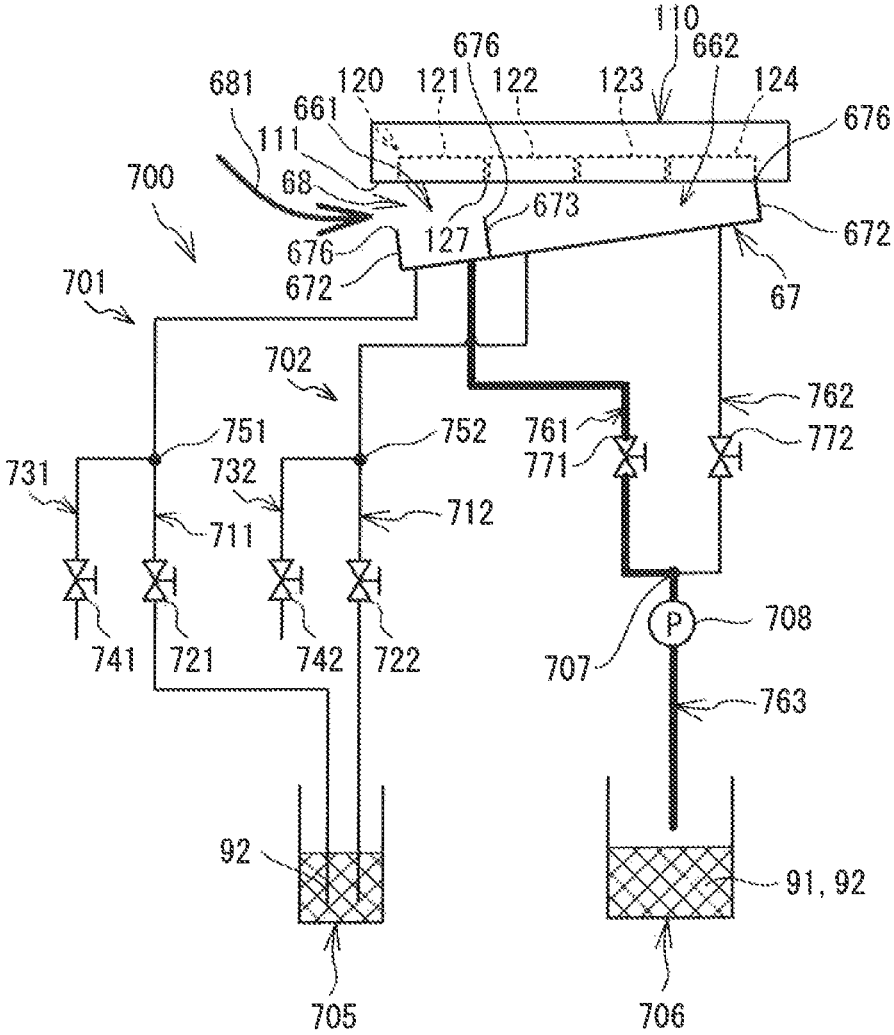
FIG. 15 is a schematic diagram of the maintenance flow path system showing a state in which air is caused to flow into the cap from a gap.

Next, the CPU 40 causes the air to flow into the first area 661 from the periphery of the cap 67 via the gap 68 (step S7). As shown in FIG. 15, at step S7, the CPU 40 causes the waste fluid opening/closing valve 771 to open and causes the supply opening/closing valve 721 and the gas opening/closing valve 741 to close. The CPU 40 causes the suction pump 708 to be driven. By the suction force of the suction pump 708, the air flows from the periphery of the cap 67 into the first area 661 via the gap 68 (refer to an arrow 681). Due to the inflowing air, bubbles of the cleaning fluid 92 attached to the cap lips 676 may be removed.

Next, the CPU 40 causes the third drive portion 196 (refer to FIG. 6) to be driven and causes the cap support portion 69 to move downward, thus moving the cap 67 to the cap separation position (refer to FIG. 16) (step S8). In this way, as shown in FIG. 16, the nozzle surface 111 is set to an uncovered state. In the uncovered state, the covering of the nozzle surface 111 by the cap 67 is released.

Next, the CPU 40 performs the nozzle surface wiping operation (step S9). As shown in FIG. 4, at step S9, the CPU 40 causes the second drive portion 195 (refer to FIG. 6) to be driven and causes the wiper 31 and the wiper support portion 32 to move from the wiper separation position (refer to FIG. 3) to the first contact position. The CPU 40 causes the main scanning drive portion 45 (refer to FIG. 6) to be driven and causes the carriage 20 to move to the right. Accordingly, the wiper 31 slides in contact with the nozzle surface 111 and wipes away the cleaning fluid 92 and the ink 91 remaining on the surface of the nozzle surface 111.

Next, the CPU 40 performs the wiper wiping operation (step S10). As shown in FIG. 5, at step S10, the CPU 40 causes the second drive portion 195 to be driven and causes the wiper 31 and the wiper support portion 32 to move from the first contact position (refer to FIG. 4) to the second contact position. The CPU 40 causes the first drive portion 194 to be driven and causes the absorption member 51 to move to the right. Accordingly, the wiper 31 slides to contact with the bottom surface of the absorption member 51, and the absorption member 51 wipes away the cleaning fluid 92 and the ink 91 that are attached to the wiper 31. The CPU 40 causes the second drive portion 195 to be driven and causes the wiper 31 to move from the second contact position (refer to FIG. 5) to the wiper separation position (refer to FIG. 3). The CPU 40 causes the first drive portion 194 (refer to FIG. 6) to be driven and causes the support plate 149 and the absorption member 51, which have been moved to the right, to move to the left. The CPU 40 causes the main scanning drive portion 45 to be driven and causes the carriage 20 to move to the left, disposing the nozzle surface 111 above the cap 67.

Next, in a similar manner to step S1, the CPU 40 causes the third drive portion 196 to be driven (refer to FIG. 6) and causes the cap support portion 69 to move upward, thus moving the cap 67 from the cap separation position (refer to FIG. 16) to the covering position (refer to FIG. 9) (step S11). In this manner, the nozzle surface 111 is set to the covered state.

Next, processing from step S12 to step S20 is performed. At step S12 to step S20, the second flow path system 702 is used and, after the ink purge operation, the cleaning operation, and the like are performed with respect to the second area 662, the nozzle surface wiping operation and the wiper wiping operation are performed. In other words, processing that is similar to that performed at step S2 to step S10 with respect to the first area 661 is performed with respect to the second area 662. The processing at step S12 to step S20 corresponds to the processing at step S2 to step S10, and therefore, the following explanation is simplified as appropriate. While the CPU 40 is performing the processing at step S12 to step S20, in a case where the first flow path system 701 is not specifically referred to, the supply opening/closing valve 721 and the waste fluid opening/closing valve 771, which are the electromagnetic valves positioned on the first flow path system 701, are constantly closed. The gas opening/closing valve 741 may be closed or may be open. Thus, in the processing at step S12 to step S20 explained below, an explanation is omitted with respect to the control of the electromagnetic valves positioned on the first flow path system 701.

The CPU 40 causes the supply opening/closing valve 722 and the gas opening/closing valve 742 to close, causes the waste fluid opening/closing valve 772 to open, and causes the suction pump 708 to be driven (step S12). Accordingly, similarly to the case of the first area 661 shown in FIG. 1, the ink 91 inside the nozzle arrays 122 to 124 is drawn out into the second area 662 and the ink 91 is stored in the second area 662 (step S12).

Next, the CPU 40 causes the supply opening/closing valve 722 to close and causes the gas opening/closing valve 742 and the waste fluid opening/closing valve 772 to open. The CPU 40 causes the suction pump 708 to be driven (step S13). Accordingly, similarly to the case of the first area 661 shown in FIG. 11, the ink 91 inside the second area 662 is discharged to the waste fluid tank 706 via the waste fluid flow paths 762 and 763 (step S13).

Next, the CPU 40 causes the supply opening/closing valve 722 and the waste fluid opening/closing valve 772 to open and causes the gas opening/closing valve 742 to close. The CPU 40 causes the suction pump 708 to be driven (step S14). Accordingly, similarly to the case of the first area 661 shown in FIG. 12, the cleaning fluid 92 is supplied from the cleaning fluid tank 705 to the second area 662 via the supply flow path 712 (step S14). In this manner, the second area 662 is filled with the cleaning fluid 92, and a portion in which the nozzle arrays 122 to 124 of the nozzle surface 111 are positioned and a portion inside the second area 662 of the cap 67 are cleaned by the cleaning fluid 92. The CPU 40 may cause the driving of the suction pump 708 to stop and stand by for a specified period of time.

Next, the CPU 40 causes the supply opening/closing valve 722 to close and causes the gas opening/closing valve 742 and the waste fluid opening/closing valve 772 to open. The CPU 40 causes the suction pump 708 to be driven (step S15). Accordingly, similarly to the case of the first area 661 shown in FIG. 13, the cleaning fluid 92 is discharged as waste fluid from the second area 662 via the waste fluid flow paths 762 and 763 (step S15).

Next, the CPU 40 causes the third drive portion 196 (refer to FIG. 6) to be driven and causes the cap support portion 69 to be tilted diagonally with respect to the horizontal direction, causing the cap 67 to tilt with respect to the nozzle surface 111 (step S16). Accordingly, similarly to the case of the first area 661 shown in FIG. 14, the gap 68 is formed between the nozzle surface 111 and the periphery of the cap 67.

Next, the CPU 40 causes the waste fluid opening/closing valve 772 to open and causes the supply opening/closing valve 722 and the gas opening/closing valve 742 to close. The CPU 40 causes the suction pump 708 to be driven (step S17). Accordingly, similarly to the case of the first area 661 shown in FIG. 15, the air flows from the periphery of the cap 67 into the second area 662 via the gap 68 (step S17). Due to the inflowing air, bubbles of the cleaning fluid 92 attached to the cap lips 676 may be removed.

Next, the CPU 40 causes the third drive portion 196 (refer to FIG. 6) to be driven and causes the cap support portion 69 to move downward, thus moving the cap 67 to the cap separation position (refer to FIG. 16) (step S18). In this way, similarly to the case of the first area 661 shown in FIG. 16, the nozzle surface 111 is set to the uncovered state.

Next, in a similar manner to step S9, the CPU 40 performs the nozzle surface wiping operation (step S19). After that, in a similar manner to step S10, the CPU 40 performs the wiper wiping operation (step S20). Next, the CPU 40 causes the third drive portion 196 (refer to FIG. 6) to be driven and causes the cap support portion 69 to move upward, thus moving the cap 67 from the cap separation position (refer to FIG. 16) to the covering position (refer to FIG. 3 and FIG. 9) (step S21). In this manner, the nozzle surface 111 is set to the covered state. Then, the CPU 40 ends the processing in a state in which the covered state is set. In other words, the state is maintained in which the nozzles arranged on the nozzle surface 111 are covered by the cap 67.

Figure 8:
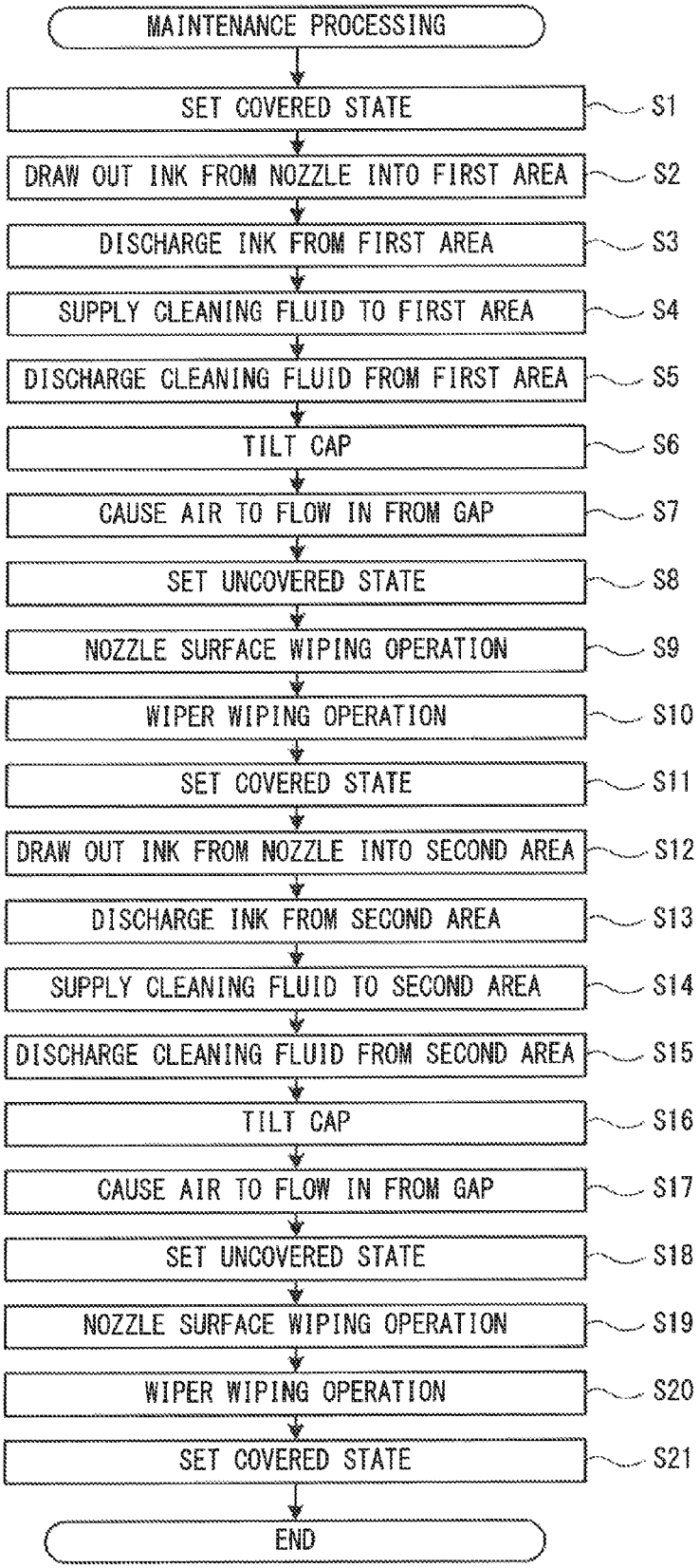
FIG. 8 is a flowchart of maintenance processing.

In the present embodiment, at step S4 and step S14 shown in FIG. 8, the nozzle surface 111 is cleaned by the cleaning fluid 92 supplied to the cap 67 (refer to FIG. 12). Then, at step S5 and step S15, after the cleaning fluid 92 is discharged from the cap 67 (refer to FIG. 13), the covering of the nozzle surface 111 by the cap 67 is released at step S8 and step S18 (refer to FIG. 16). It is assumed, for example, that the nozzle surface 111 and the cap 67 are separated from each other in a state in which the cap 67 is filled with the cleaning fluid 92. In this case, due to surface tension, it is easy for the cleaning fluid 92 to rise up onto the cap lips 676 and remain there. In the present embodiment, the nozzle surface 111 and the cap 67 are separated from each other after the cleaning fluid 92 is discharged. Therefore, it is difficult for the cleaning fluid 92 to remain on the cap lips 676, which are the leading edge portions of the cap 67 on the nozzle surface 111 side. A possibility is therefore reduced that the cleaning fluid 92 remaining on the cap lips 676 dries out and a component of the ink 91 included in the cleaning fluid 92 become firmly attached. Further, after the cleaning of the nozzle surface 111, the cleaning fluid 92 and the ink 91 remaining on the nozzle surface 111 are wiped away (refer to step S9 and step S19). Thus, the possibility that the component of the ink 91 mixed with the cleaning fluid 92 become firmly attached to the nozzle surface 111 can be reduced. Therefore, when the covered state is once more set and the cleaning is performed, it is easy for the cap 67 to fit closely to the nozzle surface 111. As a result, the nozzle surface 111 can be cleaned appropriately, and it becomes difficult for clogging of the nozzles to occur. The possibility of deterioration in the print quality can therefore be reduced.

At step S4 and step S14, the ink 91 attached to the nozzle surface 111 is cleaned by the cleaning fluid 92 (refer to FIG. 12). Therefore, the component of the ink 91 remaining on the nozzle surface 111 are less, compared to a case in which the cleaning is not performed using the cleaning fluid 92. Specifically, the ink 91 is diluted by the cleaning fluid 92. Depending on the type of a component, such as resin, that is included in the ink 91, the viscosity may be high in comparison to the cleaning fluid 92. Therefore, in comparison to a case in which the ink 91 with the higher viscosity is attached to the nozzle surface 111 without being diluted, it is easier to remove the ink 91 from the nozzle surface 111 at step S9 and step S19. Thus, the possibility that the ink 91 remains on and becomes firmly attached to the nozzle surface 111 can be reduced. As a result, it becomes difficult for clogging of the nozzles to occur, and the possibility of deterioration in the print quality can be reduced.

At step S2 and step S12, the ink 91 inside the nozzles is drawn out. Thus, it is also possible to draw out air bubbles that are mixed in with the ink 91 inside the nozzles, together with the ink 91 (refer to FIG. 10). Thus, in comparison to a case in which the air bubbles are mixed in the nozzles, the ink 91 can be appropriately ejected from the nozzles when printing is performed. As a result, print quality can be improved. Further, at step S3 and step S13, the ink 91 drawn out from the nozzles is discharged from the cap 67 (refer to FIG. 11). After that, at step S4 and step S14, the cleaning fluid 92 is supplied to the cap 67, and the cleaning of the nozzle surface 111 is performed (refer to FIG. 12). Therefore, in comparison to a case in which the cleaning fluid 92 is supplied to the cap 67 in a state in which the ink 91 drawn out from the nozzles has not been discharged from the cap 67, the amount of ink 91 remaining in the cap 67 is less. Thus, the nozzle surface 111 can be more reliably cleaned. As a result, it becomes difficult for clogging of the nozzles to occur, and the possibility of deterioration in the print quality can be reduced.

In addition, in comparison to a case in which the ink 91 drawn out from the nozzles is not discharged from the cap 67, the amount of ink 91 remaining in the cap 67 is less. It is therefore sufficient to use less amount of the cleaning fluid 92 to dilute the ink 91 and perform the cleaning. Thus, it is possible to clean the nozzle surface 111 while reducing usage amount of the cleaning fluid 92. As a result, it is possible to make it difficult for clogging of the nozzles to occur while reducing the usage amount of the cleaning fluid 92. Accordingly, the possibility of deterioration in the print quality can be reduced.

Figure 16:
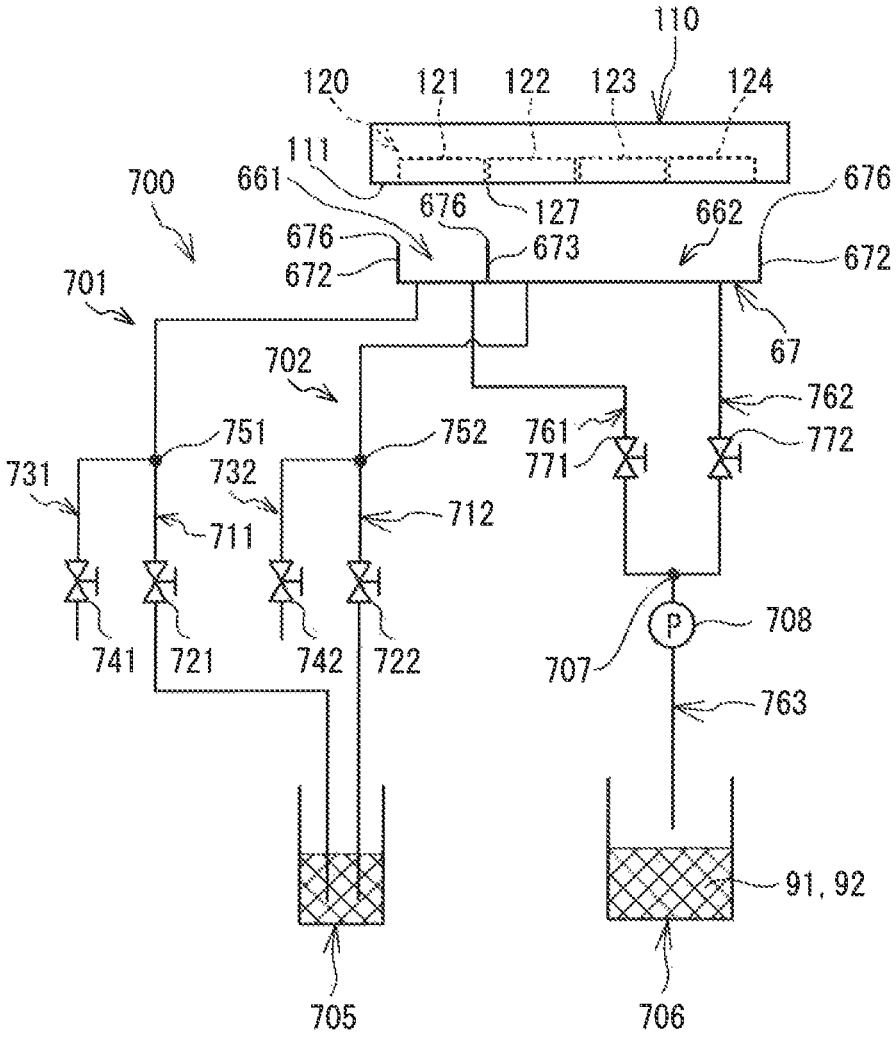
FIG. 16 is a schematic diagram of the maintenance flow path system showing a state in which the cap is in the cap separation position.

After the air is caused to flow into the cap 67 from the periphery of the cap 67 at step S7 and step S17 (refer to FIG. 15), the uncovered state is set at step S8 and step S18 (refer to FIG. 16). In other words, after the bubbles of the cleaning fluid 92 that are attached to the cap lips 676 of the cap 67 are removed, the cap 67 is separated from the nozzle surface 111. Therefore, it is possible to reduce the possibility that the bubbles of the cleaning fluid 92 dry out on the cap lips 676 and that a component of the ink 91 included in the cleaning fluid 92 become firmly attached to the cap lips 676. Therefore, in comparison to a case in which the component of the ink 91 become firmly attached to the cap lips 676, it is easy for the cap 67 to closely fit to the nozzle surface 111 when the covered state is once more set. As a result, the nozzle surface 111 can be appropriately cleaned and it becomes difficult for clogging of the nozzles to occur. Thus, the possibility of deterioration in the print quality can be reduced.

The nozzle surface 111 is cleaned at step S4 and step S14 (refer to FIG. 12), and the wiper 31 slides in contact with the nozzle surface 111 at step S9 and step S19, thus removing the cleaning fluid 92 from the nozzle surface 111 (refer to FIG. 4). After that, at step S21, the nozzle surface 111 is set to the covered state (refer to FIG. 3). At step S21, a slight amount of the cleaning fluid 92 remains in the cap 67 when the covered state is set. Therefore, when the covered state is set, the inside of the cap 67 becomes moist due to the vaporized cleaning fluid 92. In other words, in comparison to a case in which the covered state is not set, it is possible to cause the nozzle surface 111 to be moist. As a result, it is possible to reduce the possibility that the ink 91 inside the nozzles dries out and causes clogging of the nozzles. Thus, the possibility of deterioration in the print quality can be reduced.

In the covered state, the partition wall 673 closely fits to the boundary 127 between the nozzle array 121 and the nozzle arrays 122 to 124. Therefore, the space that is formed between the nozzle surface 111 and the cap 67 is divided into the first area 661 in which the nozzle array 121 is positioned and the second area 662 in which the nozzle arrays 122 to 124 are positioned. As a result, when the nozzle surface 111 is cleaned by the cleaning fluid 92, the cleaning of the nozzle array 121 and the cleaning of the nozzle arrays 122 to 124 is performed separately (step S4 and step S14). Thus, it is possible to inhibit the ink 91 of the nozzle array 121 and the ink 91 of the nozzle arrays 122 to 124 from being mixed together. In particular, in the head unit 200, the nozzle array 121 can discharge the black ink and the nozzle arrays 122, 123, and 124 can discharge the yellow ink, the cyan ink, and the magenta ink, respectively. However, by providing the partition wall 673, it is possible to inhibit the black ink from attaching to the nozzle arrays 122 to 124 and causing a mixing of colors.

Various modifications to the above-described embodiment may be made. A maintenance flow path system 710 according to a modified example of the above-described embodiment will be explained with reference to FIG. 17. In the following explanation, the same reference numerals will be assigned to configurations that are the same as the above-described embodiment and an explanation thereof will be omitted. Points that differ from the above-described embodiment will be explained. The maintenance flow path system 700 according to the above-described embodiment includes the gas channels 731 and 732, the number of which is the same as that of the supply flow paths 711 and 712. However, the maintenance flow path system 710 according to the present modified example includes a gas channel 733, the number of which is smaller than that of the supply flow paths 711 and 712. Specifically, the maintenance flow path system 710 includes two supply flow paths 711 and 712 and one gas channel 733. Further, in place of the gas opening/closing valves 741 and 742, the maintenance flow path system 710 includes a gas opening/closing valve 743. The gas opening/closing valve 743 is an electromagnetic valve that is provided on the gas channel 733.

Figure 17:
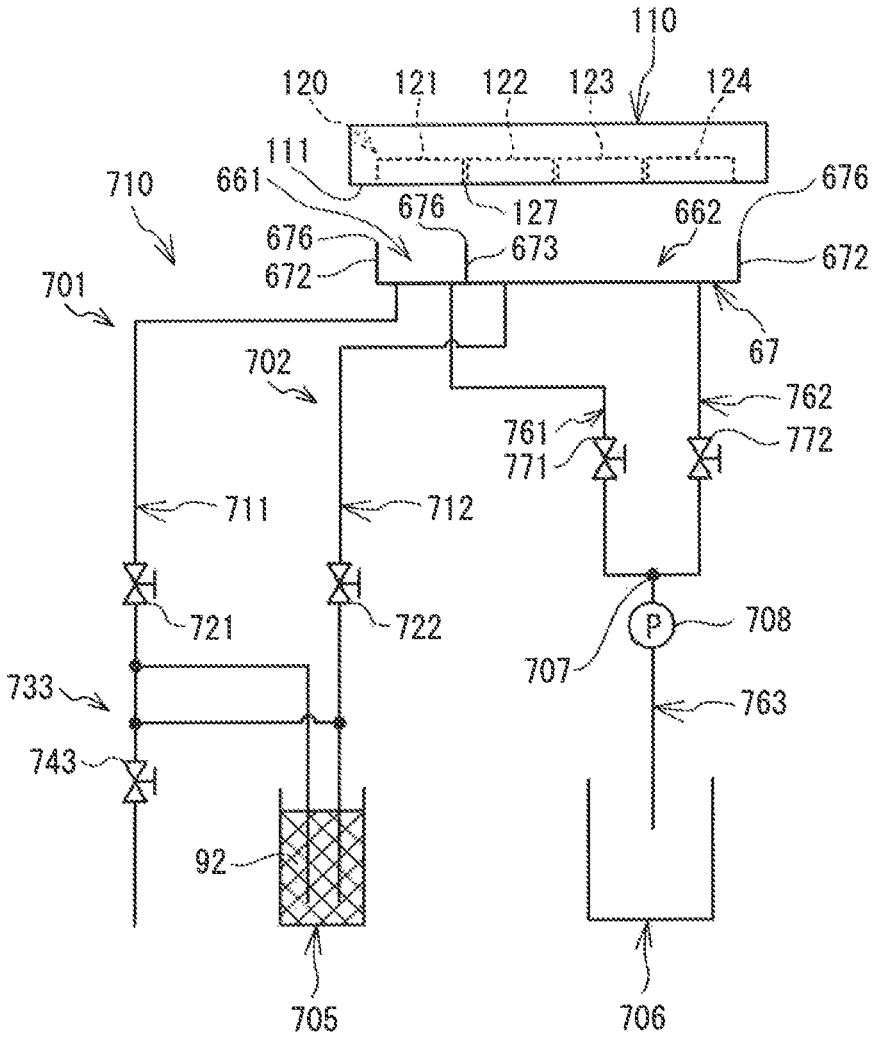
FIG. 17 is a schematic diagram of a maintenance flow path system according to a modified example, showing a state in which the cap is in the cap separation position.

Maintenance processing performed by the printer 1 that includes the maintenance flow path system 710 will be explained with reference to FIG. 8 and FIG. 17. Similarly to step S1 of the above-described embodiment, the CPU 40 causes the cap 67 to move from the cap separation position to the covering position (step S1). In this case, the CPU 40 causes the gas opening/closing valve 743 and the supply flow paths 711 and 712 to open and thus causes the first area 661 and the second area 662 of the cap 67 to communicate with the air. At least one of the supply flow paths 711 and 712 may be closed. All of the supply flow paths 711 and 712 and the gas opening/closing valve 743 may be closed.

Next, similarly to step S2 and step S3 of the above-described embodiment, the CPU 40 causes the ink 91 inside the nozzles to be drawn out into the first area 661, and causes the ink 91 to be discharged via the waste fluid flow paths 761 and 763 (step S2 and step S3). At step S2, the gas opening/closing valve 743 may be closed or may be open. At step S3, the CPU 40 causes the supply opening/closing valve 721, the gas opening/closing valve 743, and the waste fluid opening/closing valve 771 to open. The cleaning fluid 92 has viscosity. Thus, inside the supply flow path 711, the air flows easily and the cleaning fluid 92 does not flow so easily. As a result, when the suction pump 708 is driven in a state in which the supply opening/closing valve 721, the gas opening/closing valve 743, and the waste fluid opening/closing valve 771 are open, the air flows inside the supply flow path 711.

Next, similarly to step S4 and step S5 of the above-described embodiment, the CPU 40 causes the cleaning fluid 92 to be supplied from the cleaning fluid tank 705 to the first area 661 and causes the cleaning fluid 92 to be discharged via the waste fluid flow paths 761 and 763 (step S4 and step S5). At step S5, the CPU 40 causes the supply opening/closing valve 721, the gas opening/closing valve 743, and the waste fluid opening/closing valve 771 to open. Next, similarly to step S6 of the above-described embodiment, the CPU 40 causes the cap 67 to tilt with respect to the nozzle surface 111 (step S6). In this case, the CPU 40 causes the gas opening/closing valve 743 and the supply flow paths 711 and 712 to open, causing the first area 661 and the second area 662 to communicate with the air. At least one of the supply flow paths 711 and 712 may be closed. All of the supply flow paths 711 and 712 and the gas opening/closing valve 743 may be closed.

Next, similarly to step S7 to step S11 of the above-described embodiment, the CPU 40 causes the air to flow into the first area 661, causes the cap 67 to move to the cap separation position, performs the nozzle surface wiping operation and the wiper wiping operation, and causes the cap 67 to move to the covering position (step S7 to step S11). Next, processing that is the same as that performed with respect to the first area 661 at step S2 to S10 is performed with respect to the second area 662 at step S12 to step S20.

The processing from step S12 to step S20 corresponds to the processing from step S2 to step S10 and, in the following explanation, an explanation thereof is simplified as appropriate.

The CPU 40 causes the supply opening/closing valve 722 to close, causes the waste fluid opening/closing valve 772 to open, and causes the suction pump 708 to be driven (step S12). The CPU 40 causes the supply opening/closing valve 722, the gas opening/closing valve 743, and the waste fluid opening/closing valve 772 to open, and causes the suction pump 708 to be driven (step S13). The CPU 40 causes the supply opening/closing valve 722 and the waste fluid opening/closing valve 772 to open, causes the gas opening/closing valve 743 to close, and causes the suction pump 708 to be driven (step S14). The CPU 40 causes the supply opening/closing valve 722, the gas opening/closing valve 743, and the waste fluid opening/closing valve 772 to open and causes the suction pump 708 to be driven (step S15).

The CPU 40 causes the cap 67 to tilt with respect to the nozzle surface 111 (step S16). Similarly to step S17 to step S21 of the above-described embodiment, the CPU 40 causes the air to flow into the second area 662, causes the cap 67 to move to the cap separation position, performs the nozzle surface wiping operation and the wiper wiping operation, and causes the cap 67 to move to the covering position (step S17 to step S21).

As described above, in the modified example, the number of the gas channel 733 is smaller than the number of the supply flow paths 711 and 712. The gas opening/closing valve 743 is provided on the gas channel 733. In other words, the number of the gas opening/closing valve 743 is smaller than the number of the supply opening/closing valves 721 and 722. Thus, the number of components of the maintenance flow path system 710 and the printer 1 is reduced. As a result, the possibility of clogging of the flow paths by the ink can be reduced. It is therefore possible to further inhibit failure of the printer 1. Further, it is possible to reduce the electric power required to drive the gas opening/closing valve 743. In addition, it is possible to reduce the time required to assemble the maintenance flow path system 710 and the printer 1.

For example, in the above-described embodiment and modified example, after the processing at step S2 to step S10 is performed with respect to the first area 661, the processing at step S12 to step S20 is performed with respect to the second area 662. However, the processing may be performed simultaneously with respect to the first area 661 and the second area 662. There is no limit on the number of the partition walls 673. For example, three of the partition walls 673 may be provided on the cap 67. Each of the three partition walls 673 may be opposed to and fit closely to a boundary between each adjacent ones of the nozzle arrays 121 to 124. The partition wall 673 need not necessarily be provided. In this case, it is not necessary to provide the two flow path systems, namely, the first flow path system 701 and the second flow path system 702, and a single flow path may be provided.

The waste fluid opening/closing valves 771 and 772 need not necessarily be provided. The cleaning fluid tank 705 may be disposed outside the printer 1. The waste fluid tank 706 may be disposed outside the printer 1. The waste fluid tank 706 need not necessarily be provided.

In the above-described embodiment, the gas opening/closing valve 741 is closed at step S7. However, the gas opening/closing valve 741 may be open at step S7. Similarly, in the above-described embodiment, the gas opening/closing valve 742 is closed at step S17. However, the gas opening/closing valve 742 may be open at step S17. Even if the gas opening/closing valves 741 and 742 are open, as long as an aperture area of the gap 68 is larger than a cross-sectional area of the flow paths of the gas channels 731 and 732, the air flows into the cap 67 from the gap 68. Thus, it is possible to remove the bubbles attached to the cap lips 676. In the above-described modified example, the gas opening/closing valve 743 may be open at step S7. The gas opening/closing valve 743 may be open at step S17.

In the above-described embodiment and modified example, at step S6 and step S16, the cap 67 is tilted with respect to the nozzle surface 111. However, it is sufficient if the cap 67 is moved with respect to the nozzle surface 111 and a gap is formed between the nozzle surface 111 and the cap 67, and the cap 67 need not necessarily be tilted. For example, the entire cap 67 may be moved slightly downward and the entire cap 67 may be slightly separated from the nozzle surface 111, thus forming the gap 68. In this case, at step S7 and step S17, the air is caused to flow into the cap 67 from the gap 68, and the bubbles of the cleaning fluid 92 attached to the cap lips 676 may be removed. The processing at step S6, step S7, step S16, and step S17 need not necessarily be performed. Then, after the cleaning fluid 92 is discharged from the cap 67 at step S5 and step S15, the processing at step S8 and step S18 may be performed and the uncovered state may be set.

The processing at step S3 and step S13 may not be performed and the ink 91 may not be discharged from the cap 67. In this case, the cleaning fluid 92 may be supplied to the first area 661 in the state in which the ink 91 remains in the cap 67, and the nozzle surface 111 may be cleaned. The processing at step S2 and step S12 may not be performed, the ink purge operation may not be performed, and the nozzle surface 111 may be cleaned at step S4 and step S14. In the above-described embodiment and modified example, the covered state is set at step S21, and the nozzle surface 111 is caused to become moist. However, the processing at step S21 need not necessarily be performed.

In the above-described embodiment and modified example, at step S9 and step S19, the head portion 110 is moved to the right and the nozzle surface wiping operation is performed, but the present disclosure is not limited to this example. It is sufficient if the wiper 31 is moved relatively with respect to the nozzle surface 111. For example, the wiper 31 may be moved to the left with respect to the head portion 110 and the nozzle surface wiping operation may be performed. In the above-described embodiment and modified example, at step S10 and step S20, the absorption member 51 is moved to the right and the wiper wiping operation is performed, but the present disclosure is not limited to this example. It is sufficient if the absorption member 51 is moved relatively with respect to the wiper 31. For example, the wiper 31 may be moved to the right with respect to the absorption member 51 and the wiper wiping operation may be performed.

In the above-described embodiment and modified example, at step S1, step S8, step S11, step S18, and step S21, one of the covered state and the uncovered state is set by moving the cap 67 in the up-down direction, but the present disclosure is not limited to this example. It is sufficient if the cap 67 is moved relatively to the nozzle surface 111. For example, the head portion 110 may be moved in the up-down direction with respect to the cap 67. In the above-described embodiment and modified example, at step S6 and step S16, the cap 67 is moved and is tilted with respect to the nozzle surface 111, but the present disclosure is not limited to this example. It is sufficient if the cap 67 is moved relatively to the nozzle surface 111. For example, the head portion 110 may be moved and the nozzle surface 111 may be tilted with respect to the cap 67. The fluid that is ejected from the nozzle surface 111 is not limited to the ink 91. For example, the fluid ejected from the nozzle surface 111 may be a discharge agent that removes a color with which a fabric has been dyed.

In the above-described embodiment, the end portions of the gas channels 731 and 732 on the side opposite to the cap 67 side are exposed to the air, but it is sufficient if the end portions are exposed to gas. For example, the end portions of the gas channels 731 and 732 on the side opposite to the cap 67 side may be connected to a gas cylinder storing a gas other than the air. For a similar reason, in the above-described modified example, it is sufficient if the end portion of the gas channel 733 on the side opposite to the cap 67 side is exposed to gas. For example, the end portion of the gas channel 733 on the side opposite to the cap 67 side may be connected to a gas cylinder storing a gas other than the air.

In the above-described embodiment, the gas channels 731 and 732 are connected to the cap 67 via the supply flow paths 711 and 712. However, the gas channels 731 and 732 may be directly connected to the cap 67. In the above-described modified example, the gas channel 733 is connected to the cap 67 via the supply flow paths 711 and 712. However, the gas channel 733 may be directly connected to the cap 67.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A printer comprising:

a head that includes a nozzle surface, the nozzle surface being a surface including at least one nozzle configured to eject an ejection fluid;

a wiper configured to move relatively with respect to the nozzle surface, the wiper being configured to slide in contact with the nozzle surface;

a cap configured to be opposed to the nozzle surface, the cap being configured to fit closely to the nozzle surface and to cover the at least one nozzle;

a supply flow path connected to the cap, the supply flow path being a flow path configured to supply a cleaning fluid to the cap;

a supply opening/closing valve provided on the supply flow path, the supply opening/closing valve being configured to open and close the supply flow path;

a gas channel connected to the cap;

a gas opening/closing valve configured to open and close the gas channel;

a waste fluid flow path connected to the cap, the waste fluid flow path being a flow path configured to discharge the cleaning fluid supplied to the cap;

a suction portion connected to the waste fluid flow path, the suction portion being configured to perform suction; and a processor configured to:

set a covered state in which the cap covers the at least one nozzle;

supply the cleaning fluid to the cap via the supply flow path, in the covered state, by opening the supply opening/closing valve, closing the gas opening/closing valve, and driving the suction portion;

discharge, via the waste fluid flow path, the cleaning fluid supplied to the cap, in the covered state, by closing the supply opening/closing valve, opening the gas opening/closing valve, and driving the suction portion;

form a gap between the nozzle surface and the cap by moving the cap relatively with respect to the nozzle surface after the cleaning fluid is discharged from the cap;

cause air to flow into the cap from a periphery of the cap via the gap by closing the supply opening/closing valve and driving the suction portion;

set an uncovered state in which covering the at least one nozzle by the cap is released; and cause the wiper to slide in contact with the nozzle surface, in the uncovered state, by moving the wiper relatively with respect to the nozzle surface, wherein the setting the uncovered state includes setting the uncovered state after the air is caused to flow into the cap from the periphery of the cap.

2. The printer according to claim 1, wherein the processor is further configured to:

draw out the ejection fluid from the at least one nozzle into the cap, in the covered sate, by closing the supply opening/closing valve and the gas opening/closing valve and driving the suction portion; and discharge, via the waste fluid flow path, the ejection fluid drawn out from the at least one nozzle, in the covered state, by closing the supply opening/closing valve, opening the gas opening/closing valve, and driving the suction portion, and the supplying the cleaning fluid to the cap includes supplying the cleaning fluid to the cap via the supply flow path after the ejection fluid is discharged via the waste fluid flow path.

3. The printer according to claim 1, wherein the processor is further configured to:

set the covered state after the wiper slides in contact with the nozzle surface.

4. The printer according to claim 1, wherein the nozzle surface includes a plurality of nozzle arrays, a plurality of nozzles being arrayed in each of the plurality of nozzle arrays, and the at least one nozzle including the plurality of nozzles, and the cap includes a partition wall on a side, of the cap, that is configured to be opposed to the nozzle surface, the partition wall being configured to be opposed to a boundary between the plurality of nozzle arrays, and the partition wall being configured to fit closely to the boundary in the covered state.

5. A printer comprising:

a head that includes a nozzle surface, the nozzle surface being a surface including at least one nozzle configured to eject an ejection fluid;

a wiper configured to move relatively with respect to the nozzle surface, the wiper being configured to slide in contact with the nozzle surface;

a cap configured to be opposed to the nozzle surface, the cap being configured to fit closely to the nozzle surface and to cover the at least one nozzle, and the cap including a plurality of areas partitioned by a partition wall, the partition wall being provided on a side, of the cap, that is configured to be opposed to the nozzle surface;

a plurality of supply flow paths respectively connected to the plurality of areas, the plurality of supply flow paths being flow paths configured to supply a cleaning fluid to the cap;

a plurality of supply opening/closing valves respectively provided on the plurality of supply flow paths, the plurality of supply opening/closing valves being respectively configured to open and close the plurality of supply flow paths;

at least one gas channel connected to the plurality of supply flow paths, a number of the at least one gas channel being smaller than a number of the plurality of supply flow paths;

at least one gas opening/closing valve configured to open and close the at least one gas channel;

a waste fluid flow path connected to the cap, the waste fluid flow path being a flow path configured to discharge the cleaning fluid supplied to the cap;

a suction portion connected to the waste fluid flow path, the suction portion being configured to perform suction; and a processor configured to:

set a covered state in which the cap covers the at least one nozzle;

supply the cleaning fluid to the cap via at least one of the plurality of supply flow paths, in the covered state, by opening at least one of the plurality of supply opening/closing valves, closing the at least one gas opening/closing valve, and driving the suction portion;

discharge, via the waste fluid flow path, the cleaning fluid supplied to the cap, in the covered state, by opening at least one of the plurality of supply opening/closing valves, opening the at least one gas opening/closing valve, and driving the suction portion;

set an uncovered state in which covering the at least one nozzle by the cap is released; and cause the wiper to slide in contact with the nozzle surface, in the uncovered state, by moving the wiper relatively with respect to the nozzle surface.

6. The printer according to claim 5, wherein the processor is further configured to:

draw out the ejection fluid from the at least one nozzle into the cap, in the covered state, by closing at least one of the plurality of supply opening/closing valves and driving the suction portion; and discharge, via the waste fluid flow path, the ejection fluid drawn out from the at least one nozzle, in the covered state, by opening at least one of the plurality of supply opening/closing valves, opening the at least one gas opening/closing valve, and driving the suction portion, and the supplying the cleaning fluid to the cap includes supplying the cleaning fluid to the cap via at least one of the plurality of supply flow paths after the ejection fluid is discharged via the waste fluid flow path.

7. The printer according to claim 5, wherein the processor is further configured to:

form a gap between the nozzle surface and the cap by moving the cap relatively with respect to the nozzle surface after the cleaning fluid is discharged from the cap; and cause air to flow into the cap from a periphery of the cap via the gap by closing at least one of the plurality of supply opening/closing valves and driving the suction portion, and the setting the uncovered state includes setting the uncovered state after the air is caused to flow into the cap from the periphery of the cap.

8. The printer according to claim 5, wherein the processor is further configured to:

set the covered state after the wiper slides in contact with the nozzle surface.

9. The printer according to claim 5, wherein the nozzle surface includes a plurality of nozzle arrays, a plurality of nozzles being arrayed in each of the plurality of nozzle arrays, and the at least one nozzle including the plurality of nozzles, and the partition wall is configured to be opposed to a boundary between the plurality of nozzle arrays, and the partition wall being configured to fit closely to the boundary in the covered state.

10. A printer comprising:

a head that includes a nozzle surface, the nozzle surface being a surface including at least one nozzle configured to eject an ejection fluid;

a wiper configured to move relatively with respect to the nozzle surface, the wiper being configured to slide in contact with the nozzle surface;

a cap configured to be opposed to the nozzle surface, the cap being configured to fit closely to the nozzle surface and to cover the at least one nozzle, and the cap including a plurality of areas partitioned by a partition wall, the partition wall being provided on a side, of the cap, that is configured to be opposed to the nozzle surface;

a plurality of supply flow paths respectively connected to the plurality of areas, the plurality of supply flow paths being flow paths configured to supply a cleaning fluid to the cap;

a plurality of supply opening/closing valves respectively provided on the plurality of supply flow paths, the plurality of supply opening/closing valves being respectively configured to open and close the plurality of supply flow paths;

at least one gas channel configured to supply gas to each of the plurality of areas, a number of the at least one gas channel being smaller than a number of the plurality of supply flow paths;

at least one gas opening/closing valve configured to open and close the at least one gas channel;

a waste fluid flow path connected to the cap, the waste fluid flow path being a flow path configured to discharge the cleaning fluid supplied to the cap;

a suction portion connected to the waste fluid flow path, the suction portion being configured to perform suction; and a processor configured to:

set a covered state in which the cap covers the at least one nozzle;

supply the cleaning fluid to the cap via at least one of the plurality of supply flow paths, in the covered state, by opening at least one of the plurality of supply opening/closing valves, closing the at least one gas opening/closing valve, and driving the suction portion;

discharge, via the waste fluid flow path, the cleaning fluid supplied to the cap, in the covered state, by opening the at least one gas opening/closing valve and driving the suction portion;

set an uncovered state in which covering the at least one nozzle by the cap is released; and cause the wiper to slide in contact with the nozzle surface, in the uncovered state, by moving the wiper relatively with respect to the nozzle surface.

11. The printer according to claim 10, wherein the processor is further configured to:

draw out the ejection fluid from the at least one nozzle into the cap, in the covered state, by closing at least one of the plurality of supply opening/closing valves and driving the suction portion; and discharge, via the waste fluid flow path, the ejection fluid drawn out from the at least one nozzle, in the covered state, by opening at least one of the plurality of supply opening/closing valves, opening the at least one gas opening/closing valve, and driving the suction portion, and the supplying the cleaning fluid to the cap includes supplying the cleaning fluid to the cap via at least one of the plurality of supply flow paths after the ejection fluid is discharged via the waste fluid flow path.

12. The printer according to claim 10, wherein the processor is further configured to:

form a gap between the nozzle surface and the cap by moving the cap relatively with respect to the nozzle surface after the cleaning fluid is discharged from the cap; and cause air to flow into the cap from a periphery of the cap via the gap by closing at least one of the plurality of supply opening/closing valves and driving the suction portion, and the setting the uncovered state includes setting the uncovered state after the air is caused to flow into the cap from the periphery of the cap.

13. The printer according to claim 10, wherein the processor is further configured to:

set the covered state after the wiper slides in contact with the nozzle surface.

14. The printer according to claim 10, wherein the nozzle surface includes a plurality of nozzle arrays, a plurality of nozzles being arrayed in each of the plurality of nozzle arrays, and the at least one nozzle including the plurality of nozzles, and the partition wall is configured to be opposed to a boundary between the plurality of nozzle arrays, and the partition wall being configured to fit closely to the boundary in the covered state.

15. The printer according to claim 10, wherein the processor is further configured to:

set the uncovered state after discharging the cleaning fluid supplied to the cap via the waste fluid flow path.

* * * * *